US005294527A

United States Patent [19]

Deguchi

[11] Patent Number: 5,294,527

[45] Date of Patent: Mar. 15, 1994

[54] SILVER HALIDE COLOR PHOTOGRAPHIC MATERIAL

[75] Inventor: Yasuaki Deguchi, Minami-ashigara, Japan

[73] Assignee: Fuji Photo Film Co., Ltd., Kanagawa, Japan

[21] Appl. No.: 903,479

[22] Filed: Jun. 24, 1992

[30] Foreign Application Priority Data

Jun. 24, 1991 [JP] Japan ..... 3-177775

[51] Int. Cl.[5] ..... G03C 7/36; G03C 7/396

[52] U.S. Cl. ..... 430/545; 430/546; 430/551; 430/556; 430/557; 430/558

[58] Field of Search ..... 430/556, 557, 545, 546, 430/558, 631, 551

[56] References Cited

U.S. PATENT DOCUMENTS

| | | | |
|---|---|---|---|
| 4,149,886 | 4/1979 | Tanaka et al. | 430/557 |
| 4,579,816 | 4/1986 | Ohlschlager et al. | 430/544 |
| 5,001,045 | 3/1991 | Furutachi et al. | 430/545 |
| 5,006,452 | 4/1991 | Bucci | 430/544 |
| 5,071,738 | 12/1991 | Mizukura et al. | 430/546 |
| 5,100,771 | 3/1992 | Mihayashi et al. | 430/556 |
| 5,194,369 | 3/1993 | Mihayashi et al. | 430/557 |
| 5,212,052 | 5/1993 | Sakanoue et al. | 430/503 |
| 5,213,958 | 5/1993 | Motoki et al. | 430/558 |
| 5,238,803 | 8/1993 | Ichijima et al. | 430/558 |

FOREIGN PATENT DOCUMENTS

| | | |
|---|---|---|
| 0447920 | 9/1991 | European Pat. Off. . |
| 59-116747 | 7/1984 | Japan . |
| 60-222853 | 11/1985 | Japan . |
| 62-239149 | 10/1987 | Japan . |
| 62-240965 | 10/1987 | Japan . |
| 62-254149 | 11/1987 | Japan . |
| 2-300748 | 12/1990 | Japan . |
| 1204680 | 9/1970 | United Kingdom . |

*Primary Examiner*—Lee C. Wright
*Attorney, Agent, or Firm*—Birch, Stewart, Kolasch & Birch

[57] ABSTRACT

There is disclosed a silver halide color photographic material having at least one silver halide emulsion layer on a base, which comprises in said silver halide emulsion layer a dispersion including at least one yellow coupler represented by the following formula (1) or (2) and at least one water-insoluble homopolymer or copolymer:

Formula (1)

Formula (2)

wherein $X_1$ and $X_2$ each represent an alkyl group, an aryl group, or a heterocyclic group, $X_3$ represents an organic residue required to form a nitrogen-containing heterocyclic group together with the >N-, Y represents an aryl group or a heterocyclic group, and Z represents a group capable of being released upon a coupling reaction of the coupler represented by said formula with the oxidized product of a developing agent.

12 Claims, No Drawings

SILVER HALIDE COLOR PHOTOGRAPHIC MATERIAL

FIELD OF THE INVENTION

The present invention relates to a silver halide color photographic material, and more particularly to a silver halide color photographic material wherein the preservative stability of the sensitivity before its use is improved and the color reproduction and preservability of the dye images of color photographs obtained by processing it are improved.

BACKGROUND OF THE INVENTION

In silver halide color photographic materials, as photographic couplers that will react with the oxidized product of an aromatic primary amine developing agent to form color-formed dyes, generally a yellow coupler, a magenta coupler, and a cyan coupler are used in combination.

The color-formed dyes obtained from these couplers are required to have, for example, excellent spectral absorption properties and high fastness to light, heat, humidity, etc. The excellent spectral absorption properties desired in photographic materials should be such that color-formed dyes formed from respective couplers do not have undesired absorption in wavelength regions other than the desired major absorption. For example, in the case of yellow color-formed dyes, since the major absorption part of the formed dye is broad, the color reproduction of yellow hue and green hue is unsatisfactory.

In color print materials used for recording and storing images, conventionally, pivaloylacetanilide-type yellow couplers are used. However, since the major absorption of the yellow dyes obtained from these couplers is broad, the color reproduction is unsatisfactory and a technique for its improvement is desired. The fastness of the color-formed dyes obtained from the above yellow couplers is poorer than that of the color-formed dyes obtained from magenta couplers and cyan couplers, the change in color balance of the respective color-formed dyes during long-term storage is conspicuous, and therefore improvement is strongly desired.

The present inventors have found that when a malondiamide-type yellow coupler is used, since the major absorption of the yellow dye image is sharp in comparison with conventional pivaloylacetanilide-type yellow couplers, the color reproduction is improved; but it has been found that for color photographic materials, particularly, for example, color print papers, which will be exposed to light for a long period of time or which are required to be suitable for storage in a place having a high humidity and a high temperature for a long period of time, further improvement in image stability is desirable.

Thus, to improve light-fastness of such yellow color-formed dyes, steric hindrance phenol compounds described, for example, in JP-A ("JP-A" means unexamined published Japanese patent application) Nos. 48535/1979 and 222853/1985, polyalkylpiperidine compounds described, for example, in JP-B ("JP-B" means examined Japanese patent publication) No. 20617/1982 and JP-A Nos. 116747/1984 and 11935/1984, and compounds described, for example, in JP-A Nos. 239149/1987, 240965/1987, 254149/1987, and 300748/1990, are known, and when yellow couplers are used in combination with these compounds, fastness to light is indeed improved.

However, even though the conventional attempt to improve image preservability by using a combination of an image stabilizer with a malondiamide-type coupler exhibits an effect, in many cases such an attempt is attended with lowering of other various photographic performances. For example, although stability to light can be increased, not all performances can be satisfied fully; for example preservability in darkness cannot be improved or is deteriorated, or, particularly when color photographic materials using a high silver chloride emulsion with a silver halide content of 90 mol % or more are stored after the production, a change in sensitivity is brought about.

SUMMARY OF THE INVENTION

Therefore, the object of the present invention is to provide a silver halide photographic material which is excellent in stability of photographic sensitivity against storage after the production thereof and wherein deterioration of dyes formed after processing is less when exposed to light for a long period of time or when stored in dark places with a high temperature and a high humidity.

Other and further objects, features, and advantages of the invention will be appear more fully from the following description.

DETAILED DESCRIPTION OF THE INVENTION

The above object has been accomplished by providing a silver halide color photographic material having at least one silver halide emulsion layer on a base, which comprises in said silver halide emulsion layer a dispersion including at least one yellow coupler represented by the following formula (1) or (2) together with at least one water-insoluble homopolymer or copolymer:

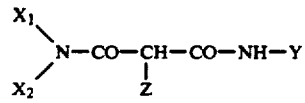

Formula (1)

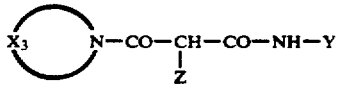

Formula (2)

wherein $X_1$ and $X_2$ each represent an alkyl group, an aryl group, or a heterocyclic group, $X_3$ represents an organic residue required to form a nitrogen-containing heterocyclic group together with the >N-, Y represents an aryl group or a heterocyclic group, and Z represents a group capable of being released upon a coupling reaction of the coupler represented by said formula with the oxidized product of a developing agent.

Specified constitution of the present invention will be described in detail.

In formula (1) or (2), when $X_1$ and $X_2$ represent an alkyl group, the alkyl group is a straight-chain, branched chain, or cyclic, saturated or unsaturated, substituted or unsubstituted alkyl group having 1 to 30, preferably 1 to 20 carbon atoms. Examples of the alkyl group are methyl, ethyl, propyl, butyl, cyclopropyl, allyl, t-octyl, i-butyl, dodecyl, and 2-hexyldecyl.

When $X_1$ and $X_2$ represent a heterocyclic group, the heterocyclic group is a 3- to 12-membered, preferably a 5- to 6-membered, saturated or unsaturated, substituted or unsubstituted, monocyclic or condensed ring heterocyclic group having 1 to 20, preferably 1 to 10 carbon atoms, and at least one heteroatom, such as a nitrogen atom, an oxygen atom, or a sulfur atom. As an example of the heterocyclic group, 3-pyrrolidinyl, 1,2,4-triazole-3-yl, 2-pyridyl, 4-prymidinyl, 3-pyrazolyl, 2-pyrrolyl, 2,4-dioxo-1,3-imidazolidine-5-yl, or pyranyl can be mentioned.

When $X_1$ and $X_2$ represent an aryl group, the aryl group is a substituted or unsubstituted aryl group having 6 to 20 carbon atoms, preferably 6 to 10 carbon atoms. As a typical example of the aryl group, a phenyl group and a naphthyl group can be mentioned.

When $X_3$ represents a nitrogen-containing heterocyclic group together with the >N-, the heterocyclic group is a 3- to 12-membered, preferably 5- to 6-membered, substituted or unsubstituted, saturated or unsaturated, monocyclic or condensed ring heterocyclic group that have 1 to 20, preferably 1 to 15 carbon atoms and may contain in addition to the nitrogen atom, for example, an oxygen atom or a sulfur atom as heteroatom. As an example of the heterocyclic group, pyrrolidino, piperidino, morpholino, 1-piperazinyl, 1-indolinyl, 1,2,3,4-tetrahydroquinoline-1-yl, 1-imidazolidinyl, 1-pyrazolyl, 1-pyrrolinyl, 1-pyrazolidinyl, 2,3-dihydro-1-indazolyl, 2-isoindolinyl, 1-indolyl, 1-pyrrolyl, 4-thiazine-S,S-dioxo-4-yl or benzoxadine-4-yl can be mentioned.

When $X_1$ and $X_2$ represent a substituted alkyl, aryl or heterocyclic group and $X_3$ represents a substituted nitrogen-containing heterocyclic group together with the >N-, examples of the substituent include: a halogen atom (e.g., fluorine and chlorine), an alkoxycarbonyl group (having preferably 2 to 30 carbon atoms, more preferably 2 to 20 carbon atoms, e.g., methoxycarbonyl, dodecyloxycarbonyl, and hexadecyloxycarbonyl), an acylamino group (having preferably 2 to 30, more preferably 2 to 20 carbon atoms, e.g., acetamido, tetradecaneamido, 2-(2,4-di-t-amylphenoxy)butaneamido, and benzamido), a sulfonamido group (having preferably 1 to 30, more preferably 1 to 20 carbon atoms, e.g., methanesulfonamido, dodecanesulfonamido, hexadecylsulfonamido, and benzenesulfonamido), a carbamoyl group (having preferably 1 to 30, more preferably 1 to 20 carbon atoms, e.g., N-butylcarbamoyl and N,N-diethylcarbamoyl), an N-sulfonylcarbamoyl group (having preferably 1 to 30, more preferably 1 to 20 carbon atoms, e.g., N-mesylcarbamoyl and N-dodecylsulfonylcarbamoyl), a sulfamoyl group (having preferably 1 to 30, more preferably 1 to 20 carbon atoms, e.g., N-butylsulfamoyl, N-dodecylsulfamoyl, N-hexadecylsulfamoyl, N-3-(2,4-di-t-amylphenoxy)butylsulfamoyl, and N,N-diethylsulfamoyl), an alkoxy group (having preferably 1 to 30, more preferably 1 to 20 carbon atoms, e.g., methoxy, hexadecyloxy, and isopropoxy), an aryloxy group (having preferably 6 to 20, more preferably 6 to 10 carbon atoms, e.g., phenoxy, 4-methoxyphenoxy, 3-t-butyl-hydroxyphenoxy, and naphthoxy), an aryloxycarbonyl group (having preferably 7 to 21, preferably 7 to 11 carbon atoms, e.g., phenoxycarbonyl), an N-acylsulfamoyl group (having preferably 2 to 30, more preferably 2 to 20 carbon atoms, e.g., N-propanoylsulfamoyl and N-tetradecanoylsulfamoyl), a sulfonyl group (having preferably 1 to 30, more preferably 1 to 20 carbon atoms, e.g., methanesulfonyl, octanesulfonyl, 4-hydroxyphenylsulfonyl, and dodecanesulfonyl), an alkoxycarbonylamino group (having preferably 1 to 30, more preferably 1 to 20 carbon atoms, e.g., ethoxycarbonylamino), a cyano group, a nitro group, a carboxyl group, a hydroxyl group, a sulfo group, an alkylthio group (having preferably 1 to 30, more preferably 1 to 20 carbon atoms, e.g., methylthio, dodecylthio, and dodecylcarbamoylmethylthio), a ureido group (having preferably 1 to 30, more preferably 1 to 20 carbon atoms, e.g., N-phenylureido and N-hexadecylureido), an aryl group (having preferably 6 to 20, more preferably 6 to 10 carbon atoms, e.g., phenyl, naphthyl, and 4-methoxyphenyl), a heterocyclic group (which is a 3- to 12-membered, preferably 5- to 6-membered, monocyclic or condensed ring having preferably 1 to 20, more preferably 1 to 10 carbon atoms and containing at least one heteroatom, such as a nitrogen atom, an oxygen atom, and a sulfur atom, e.g., 2-pyridyl, 3-pyrazolyl, 1-pyrrolyl, 2,4-dioxo-1,3-imidazolidine-1-yl, 2-benzoxazolyl, morpholino, and indolyl), an alkyl group (which may be straight-chain, branched chain, or cyclic and saturated or unsaturated, and has preferably 1 to 30, more preferably 1 to 20 carbon atoms, e.g., methyl, ethyl, isopropyl, cyclopropyl, t-pentyl, t-octyl, cyclopentyl, t-butyl, s-butyl, dodecyl, and 2-hexyldecyl), an acyl group (having preferably 1 to 30, more preferably 2 to 20 carbon atoms, e.g., acetyl and benzoyl), an acyloxy group (having preferably 2 to 30, more preferably 2 to 20 carbon atoms, e.g., propanoyloxy and tetradecanoyloxy), an arylthio group (having preferably 6 to 20, more preferably 6 to 10 carbon atoms, e.g., phenylthio and naphthylthio), a sulfamoylamino group (having preferably 0 to 30, more preferably 0 to 20 carbon atoms, e.g., N-butyl-sulfamoylamino, N-dodecylsulfamoylamino, and N-phenylsulfamoylamino), or an N-sulfonylsulfamoyl group (having preferably 1 to 30, more preferably 1 to 20 carbon atoms, e.g., N-mesylsulfamoyl, N-ethanesulfonylsulfamoyl, N-dodecanesulfonylsulfamoyl, and N-hexadecanesulfonylsulfamoyl). These substituents may be further substituted. Examples of the substituent include those mentioned above.

Among the above substituents, preferable one includes, for example, an alkoxy group, a halogen atom, an alkoxycarbonyl group, an acyloxy group, an acylamino group, a sulfonyl group, a carbamoyl group, a sulfamoyl group, a sulfonamido group, a nitro group, an alkyl group, or an aryl group.

When Y in formulas (1) and (2) represents an aryl group, the aryl group is a substituted or unsubstituted aryl group having preferably 6 to 20, more preferably 6 to 10 carbon atoms. Typical examples thereof are a phenyl group and a naphthyl group.

When Y in formulas (1) and (2) represents a heterocyclic group, the heterocyclic group has the same meaning as that of the heterocyclic group represented by $X_1$ and $X_2$.

When Y represents a substituted aryl group or a substituted heterocyclic group, examples of the substituent include those mentioned as examples of the substituent possessed by $X_1$. Preferable examples of the substituted aryl group and heterocyclic group represented by Y are those wherein the substituted group has a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, an N-sulfonylcarbamoyl group, a sulfonamido group, or an alkyl group.

A particularly preferable example of Y is a phenyl group having at least one substituent in the ortho position.

The group represented by Z in formulas (1) and (2) may be any one of conventionally known coupling releasing groups. Preferably Z includes, for example, a nitrogen-containing heterocyclic group bonded to the coupling site through the nitrogen atom, an aryloxy group, an arylthio group, a heterocyclic oxy group, a heterocyclic thio group, an acyloxy group, a carbamoyloxy group, an alkylthio group, or a halogen atom.

These coupling releasing groups may be any one of non-photographically useful groups, photographically useful groups, or precursors thereof (e.g., a development retarder, a development accelerator, a desilvering accelerator, a fogging agent, a dye, a hardener, a coupler, a developing agent oxidized product scavenger, a fluorescent dye, a developing agent, or an electron transfer agent).

When Z is a photographically useful group, one which is conventionally known is useful. For example, photographically useful groups described, for example, in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571, or 4,741,994, and Europe Publication Patent No. 193389 A, 348139 A, or 272573 A or coupling releasing groups for releasing them (e.g., a timing group) are used.

When Z represents a nitrogen-containing heterocyclic group bonded to the coupling site through the nitrogen atom, preferably Z represents a 5- to 6-membered, substituted or unsubstituted, saturated or unsaturated, monocyclic or condensed ring heterocyclic group having preferably 1 to 15 carbon atoms, more preferably 1 to 10 carbon atoms. As heteroatom, in addition to the nitrogen atom, an oxygen atom or a sulfur atom may be present. As a preferable example of the heterocyclic group, 1-pyrazolyl, 1-imidazolyl, pyrrolino, 1,2,4-triazole-2-yl, 1,2,3-triazole-1-yl, benzotriazolyl, benzimidazolyl, imidazolidine-2,4-dione-3-yl, oxazolidine-2,4-dione-3-yl, 1,2,4-triazolidine-3,5-dione-4-yl, 2-imidazolidine-2,4,5-trion-3-yl, 2-imidazolinone-1-yl-, 3,5-dioxomorpholino, or 1-indazolyl can be mentioned. When these heterocyclic groups are substituted, the substituent includes those mentioned as examples of the substituent which may be possessed by the $X_1$ group. Preferable substituents are those wherein one substituent is an alkyl group, an alkoxy group, a halogen atom, an alkoxycarbonyl group, an aryloxycarbonyl group, an alkylthio group, an acylamino group, a sulfonamido group, an aryl group, a nitro group, a carbamoyl group, or a sulfonyl group.

When Z represents an aromatic oxy group, preferably the aromatic oxy group is a substituted or unsubstituted aromatic oxy group having 6 to 10 carbon atoms, and more preferably a substituted or unsubstituted phenoxy group. If the aromatic oxy group is substituted, examples of the substituent include those mentioned as examples of the substituent which may be possessed by $X_1$ mentioned above. Among them, preferable substituents are those wherein at least one substituent is an electron-attractive substituent, such as a sulfonyl group, an alkoxycarbonyl group, a sulfamoyl group, a halogen atom, a carboxyl group, a carbamoyl group, a nitro group, a cyano group, or an acyl group.

When Z represents an aromatic thio group, preferably the aromatic thio group is a substituted or unsubstituted aromatic thio group having 6 to 10 carbon atoms, more preferably a substituted or unsubstituted phenylthio group. When the aromatic thio group is substituted, examples of the substituent include those mentioned as examples of the substituent which may be possessed by $X_1$ mentioned above. Among them, preferable substituents are those wherein at least one substituent is an alkyl group, an alkoxy group, a sulfonyl group, an alkoxycarbonyl group, a sulfamoyl group, a halogen atom, a carbamoyl group, or a nitro group.

When Z represents a heterocyclic oxy group, preferably the heterocyclic moiety has 1 to 20 carbon atoms, and more preferably 1 to 10 carbon atoms and at least one heteroatom, for example, one nitrogen atom, one oxygen atom, or one sulfur atom and is 3- to 12-membered, more preferably 5- to 6-membered, substituted or unsubstituted, saturated or unsaturated, monocyclic or condensed ring, heterocyclic group. As an example of the heterocyclic oxy group, a pyridyloxy group, a pyrazolyloxy group, or a furyloxy group can be mentioned. When the heterocyclic oxy group is substituted, examples of the substituent include those mentioned as examples of the substituent which may be possessed by $X_1$ mentioned above. Among them, preferable substituents are those wherein at least one substituent is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, or a sulfonyl group.

When Z represents a heterocyclic thio group, preferably the heterocyclic moiety has 1 to 20 carbon atoms, and more preferably 1 to 10 carbon atoms and at least one heteroatom, for example, one nitrogen atom, one oxygen atom, or one sulfur atom and is 3- to 12-membered, more preferably 5- to 6-membered, substituted or unsubstituted, saturated or unsaturated, monocyclic or condensed ring, heterocyclic group. As an example of the heterocyclic thio group, a tetrazolylthio group, a 1,3,4-thiadiazolylthio group, a 1,3,4-oxadiazolylthio group, a 1,3,4-triazolylthio group, a benzoimidazolylthio group, a benzothiazolylthio group, or a 2-pyridylthio group can be mentioned. When the heterocyclic thio group is substituted, examples of the substituent include those mentioned as examples of the substituent which may be possessed by $X_1$ mentioned above. Among them, preferable substituents are those wherein at least one substituent is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, a heterocyclic group, or a sulfonyl group.

When Z represents an acyloxy group, the acyloxy group is a monocyclic or condensed ring, substituted or unsubstituted, aromatic acyloxy group preferably having 6 to 10 carbon atoms or a substituted or unsubstituted aliphatic acyloxy group preferably having 2 to 30 carbon atoms, and more preferably 2 to 20 carbon atoms. When the acyloxy group is substituted, examples of the substituent include those mentioned as examples of the substituent which may be possessed by $X_1$ mentioned above.

When Z represents a carbamoyloxy group, the carbamoyloxy group is an aliphatic or aromatic or heterocyclic, substituted or unsubstituted carbamoyloxy group preferably having carbon atoms of 1 to 30, and more preferably 1 to 20. As an example, N,N-diethylcarbamoyloxy, N-phenylcarbamoyloxy, 1-imidazolylcarbonyloxy, or 1-pyrrolocarbonyloxy can be mentioned. When the carbamoyloxy group is substituted, examples of the substituent include those mentioned as examples of the substituent which may be possessed by $X_1$ mentioned above.

When Z represents an alkylthio group, the alkylthio group is a substituted or unsubstituted, straight-chain, branched chain, or cyclic, saturated or unsaturated alkylthio group having preferably 1 to 30, more preferably 1 to 20 carbon atoms. When the alkylthio group is substituted, examples of the substituent include those mentioned as examples of the substituent which may be possessed by $X_1$ mentioned above.

Now, couplers represented by formulas (1) and (2) that fall in a particularly preferable range will be described.

The group represented by $X_1$ in formula (1) is preferably an alkyl group, and particularly preferably an alkyl group having 1 to 10 carbon atoms.

The group represented by Y in formulas (1) and (2) is preferably an aromatic group, and particularly preferably a phenyl group having at least one substituent in the ortho position. The substituent includes those mentioned above, which may be possessed by the aromatic group represented by Y. Preferable substituents include preferable ones mentioned above, which may be possessed by the aromatic group represented Y.

The group represented by Z in formulas (1) and (2) includes preferably a 5- to 6-membered nitrogen-containing heterocyclic group bonded to the coupling site through the nitrogen atom, an aromatic oxy group, a 5- to 6-membered heterocyclic oxy group, or a 5- to 6-membered heterocyclic thio group.

Preferable couplers in formulas (1) and (2) are represented by the following formula (I), (II), or (III):

Formula (I)

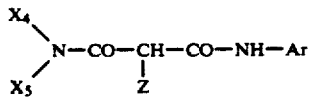

Formula (II)

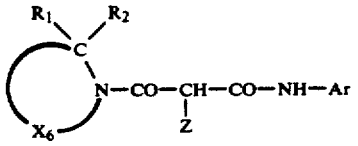

Formula (III)

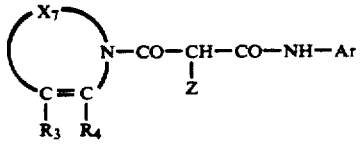

wherein Z has the same meaning as defined in formula (II), $X_4$ represents an alkyl group, $X_5$ represents an alkyl group or an aromatic group, Ar represents a phenyl group having at least one substituent in the ortho position, $X_6$ represents an organic residue required to form a nitrogen-containing cyclic group (monocyclic or condensed ring) together with the $-C(R_1R_2)-N<$, $X_7$ represents an organic residue required to form a nitrogen heterocyclic group (monocyclic or condensed ring) together with the $-C(R_3)=C(R_4)-N<$, and $R_1$, $R_2$, $R_3$, and $R_4$ each represent a hydrogen atom or a substituent.

Preferable examples of substituent in the ortho position of phenyl group represented by Ar in formula (III) include, for example, a halogen atom, an alkyl group (including a substituted alkyl, such as trifluoromethyl), an alkoxy group, and a phenoxy group. Further, on another position, particularly preferably on the metha position, of the phenyl group, one or more substituents may be introduced, and as a preferable substituent can be mentioned a halogen atom, an alkoxy group, an alkoxycarbonyl group, a carbonamido group, a sulfonamido group, a carbamoyl group, a sulfonyl group, and a sulfamoyl group (including an acylsulfamoyl or the like). These substituents may be further substituted.

With respect to a detailed description and a preferable range of the groups represented by $X_4$ to $X_7$, Ar, and Z in formulas (I) to (III), the description in the relevant range described for formulas (1) and (2) is applied. When $R_1$ to $R_4$ represent a substituent, examples include those substituents that may be possessed by $X_1$ mentioned above.

Among the couplers represented by the above mentioned formulas, particularly preferable couplers are those represented by formula (II) or (III).

The couplers represented by formulas (1) and (2) or (I) to (III) may form a dimer or higher polymer (e.g., a telomer or a polymer) by bonding at the groups represented by $X_1$ to $X_7$, Y, Ar, $R_1$ to $R_4$, and Z through a divalent group or more higher polyvalent group. In that case, the number of carbon atoms may fall outside the range of the number of carbon atoms defined in the above-mentioned substituents.

Preferable examples of the couplers represented by formulas (1) and (2) or (I) to (III) are nondiffusible couplers. The term "nondiffusible couplers" refers to couplers having in the molecule a group with a molecular weight large enough to make the molecule immobilized in the layer in which the molecule is added. Generally an alkyl group having a total number of carbon atoms of 8 to 30, preferably 10 to 20, or an aryl group having a total number of carbon atoms of 4 to 40, is used. These nondiffusible groups may be substituted on any position in the molecule, and two or more of them may be present in the molecule.

Specific examples of the couplers represented by formulas (1), (2) and (I) to (III) are shown below, but the present invention is not restricted to them.

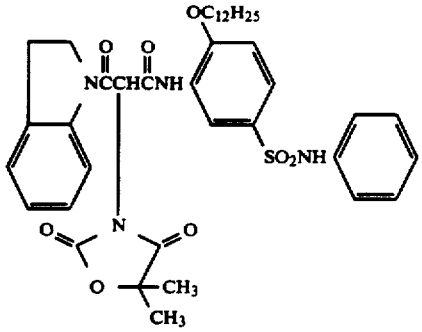
Y-1
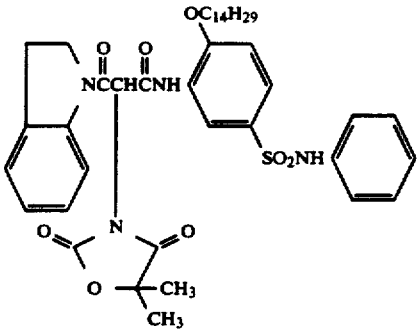
Y-2
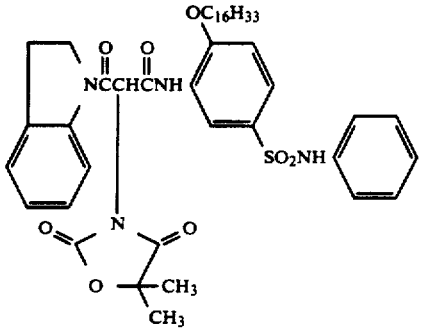
Y-3
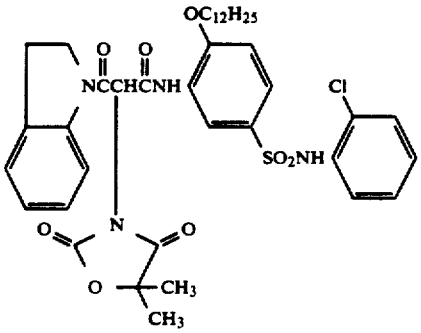
Y-4
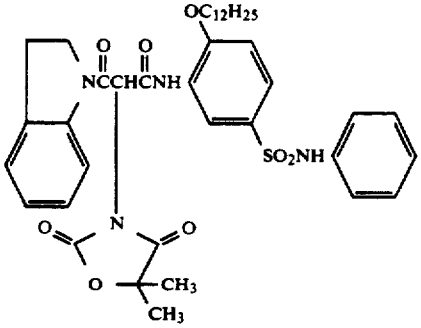
Y-5
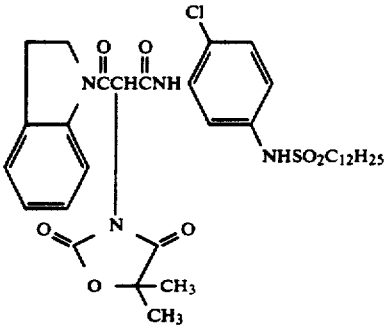
Y-6
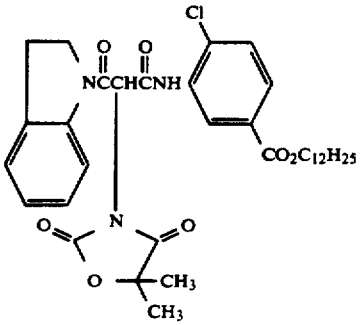
Y-7
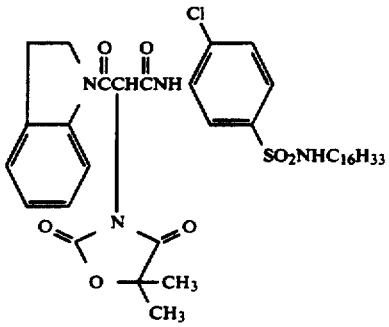
Y-8

-continued
Y-9
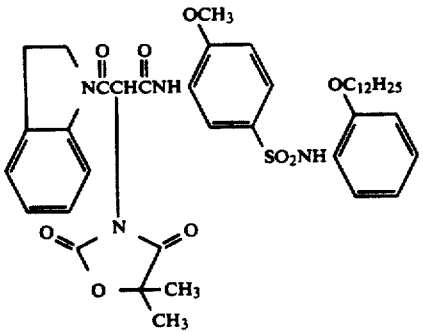
Y-10
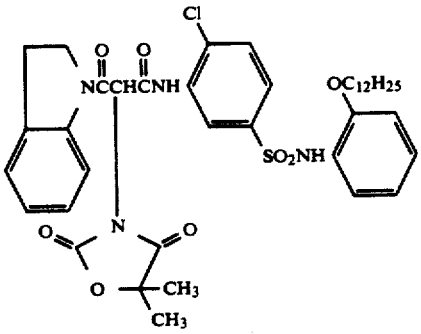
Y-11
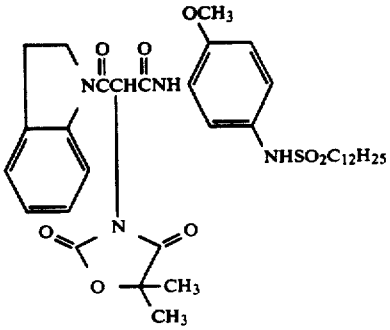
Y-12
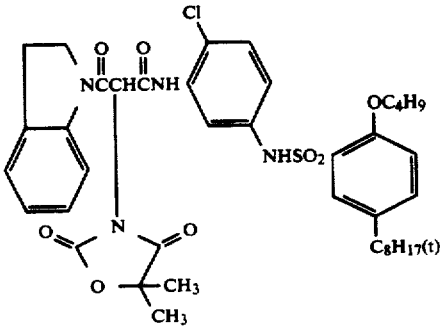
Y-13
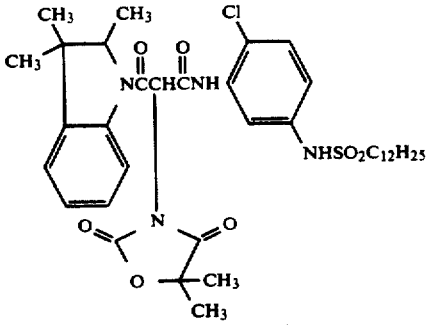
Y-14
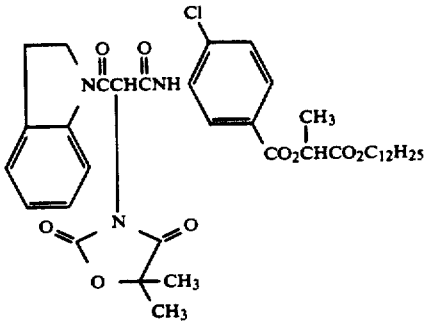
Y-15
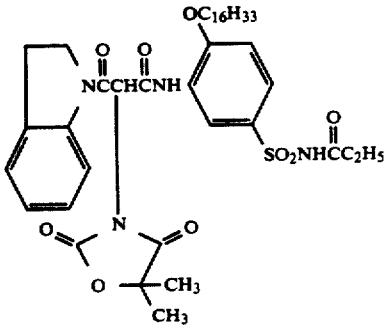
Y-16
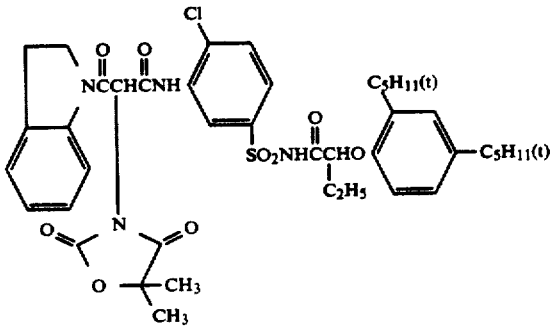

-continued
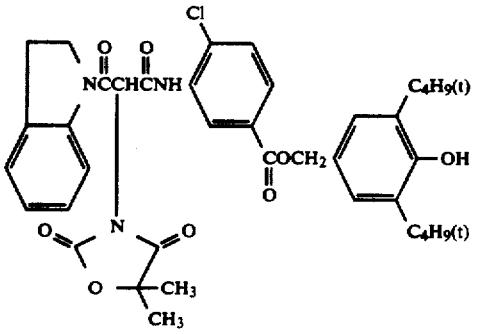
Y-17
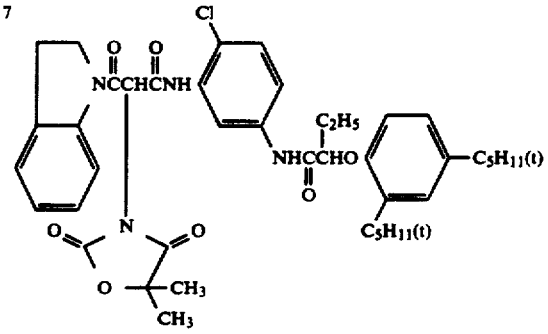
Y-18
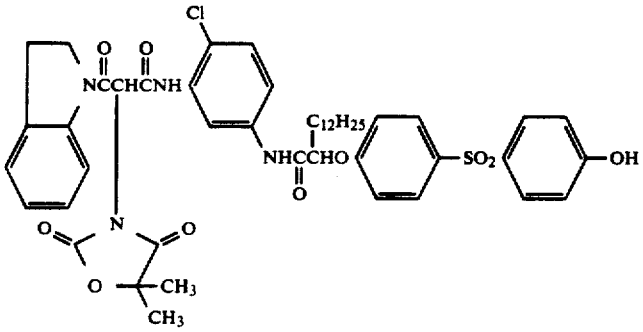
Y-19
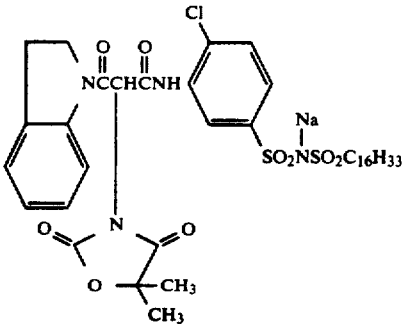
Y-20
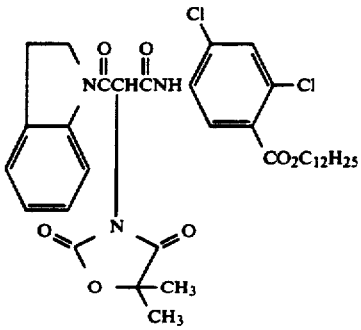
Y-21
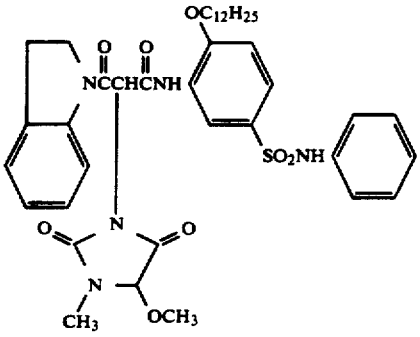
Y-22
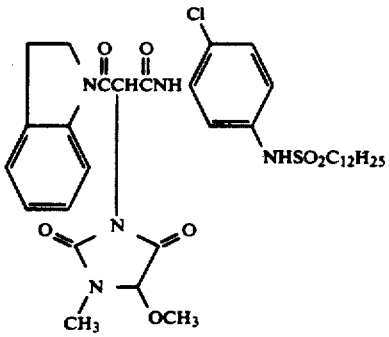
Y-23

-continued
Y-24
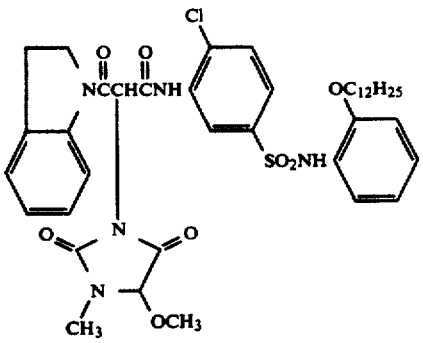
Y-25
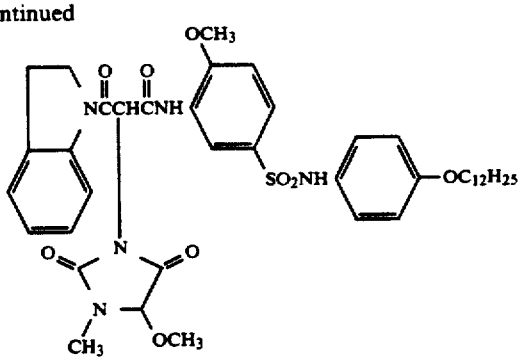
Y-26
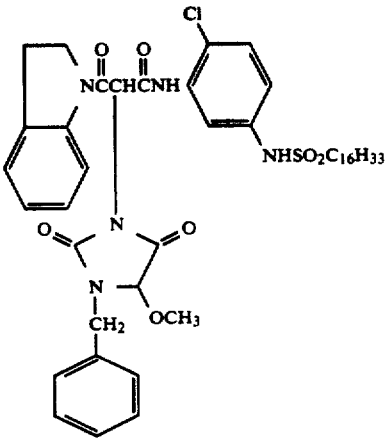
Y-27
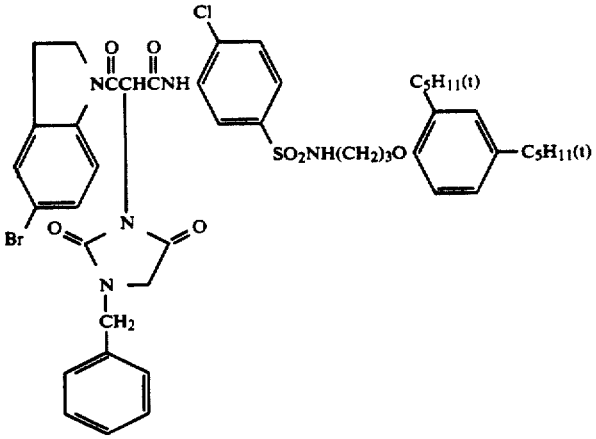
Y-28
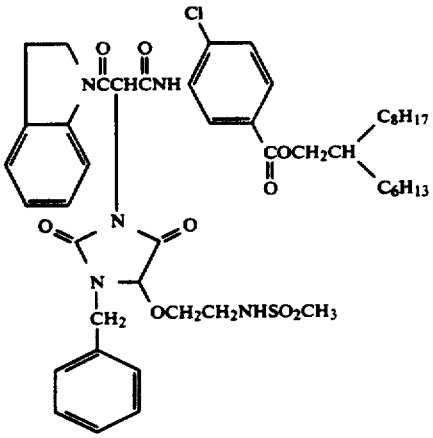
Y-29
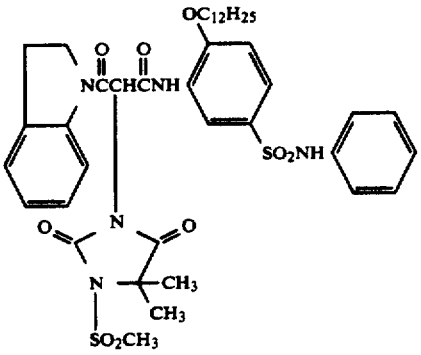

-continued
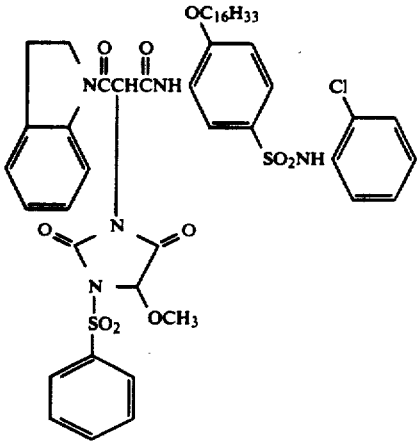
Y-30
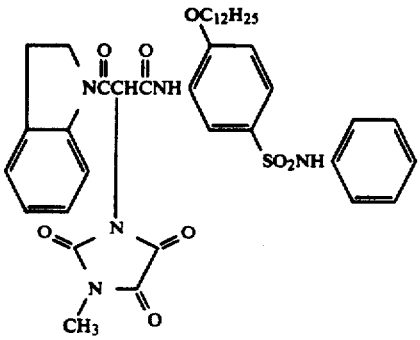
Y-31
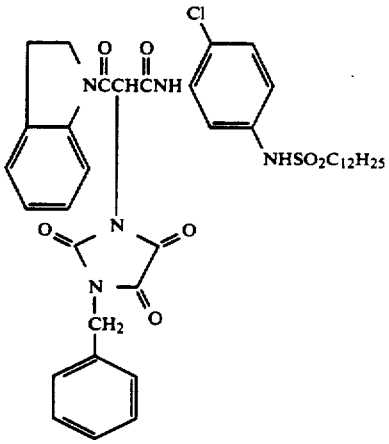
Y-32
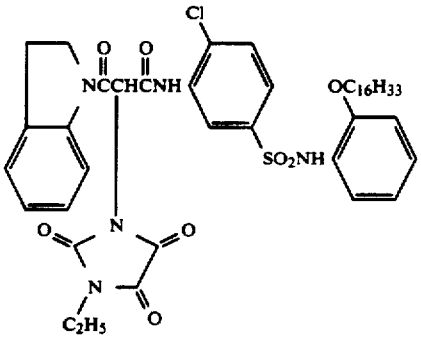
Y-33
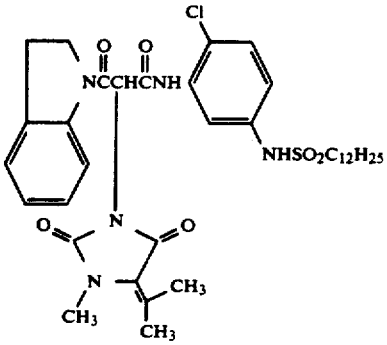
Y-34
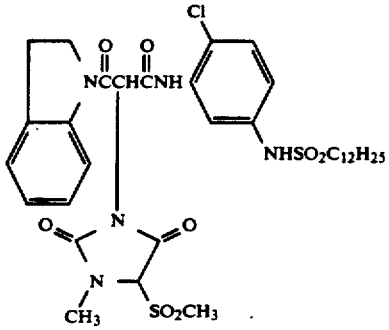
Y-35

-continued
Y-36
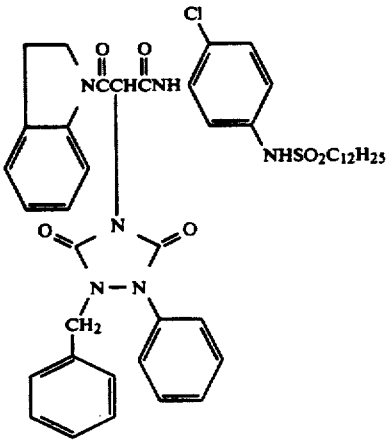
Y-37
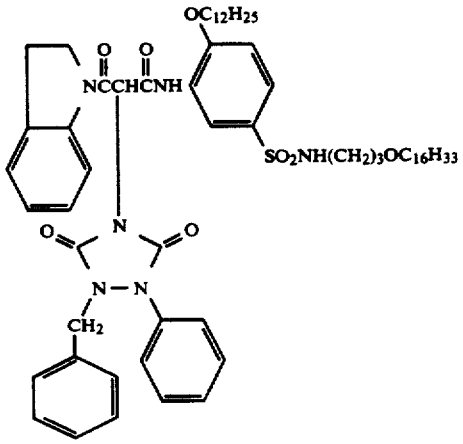
Y-38
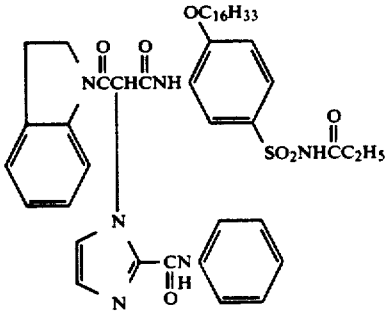
Y-39
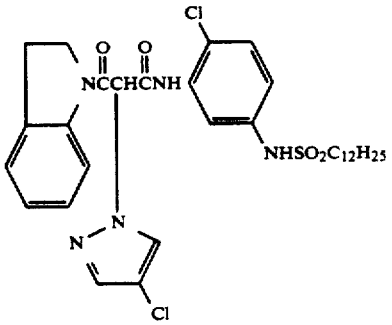
Y-40
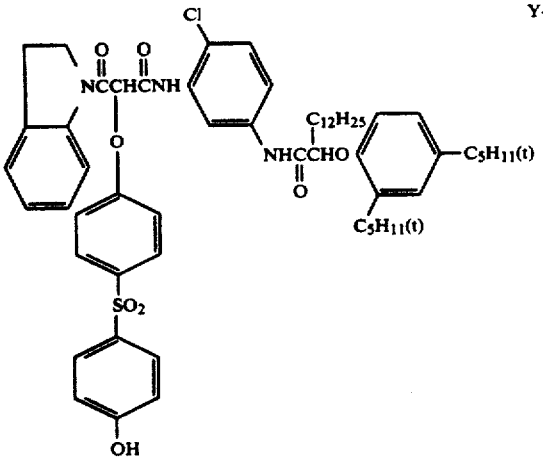
Y-41
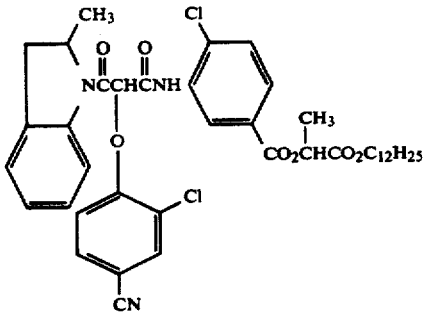

-continued
Y-42
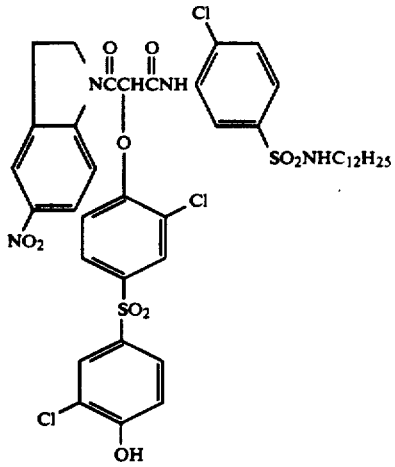
Y-43
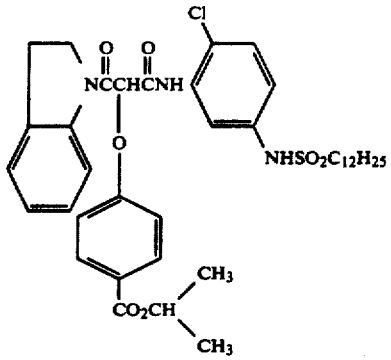
Y-44
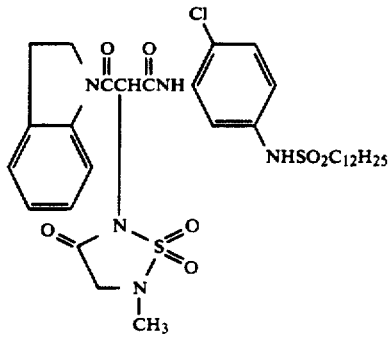
Y-45
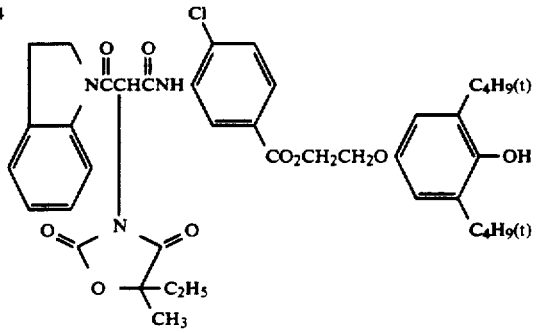
Y-46
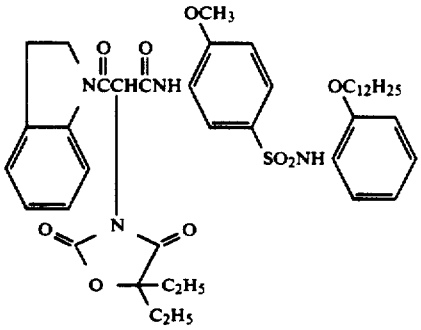
Y-47
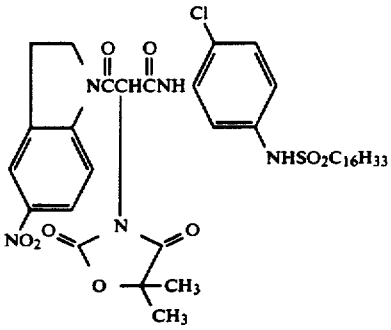
Y-48
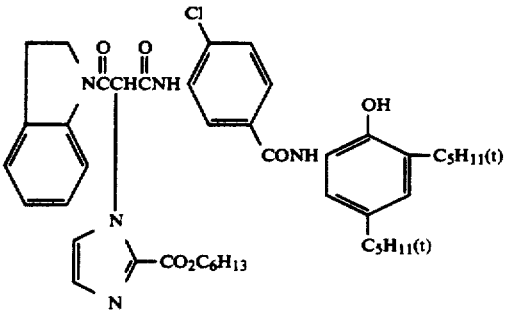
Y-49
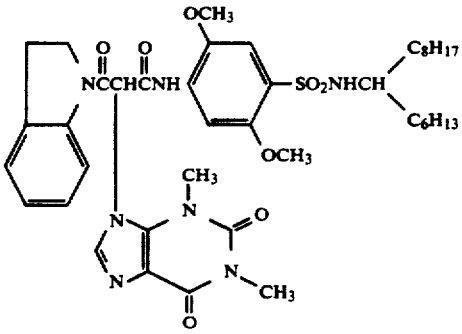

-continued
Y-50
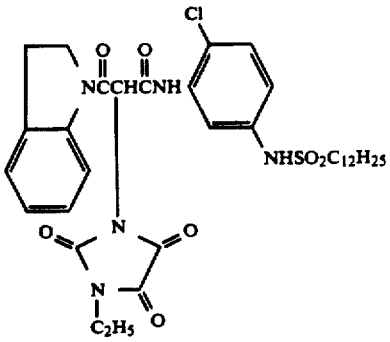
Y-51
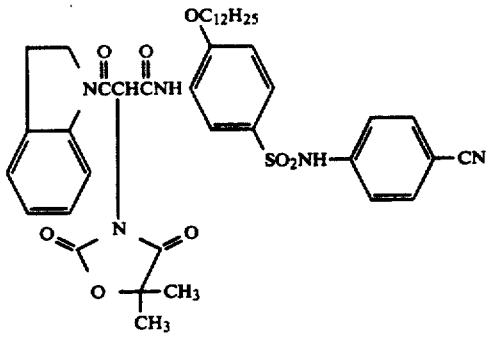
Y-52
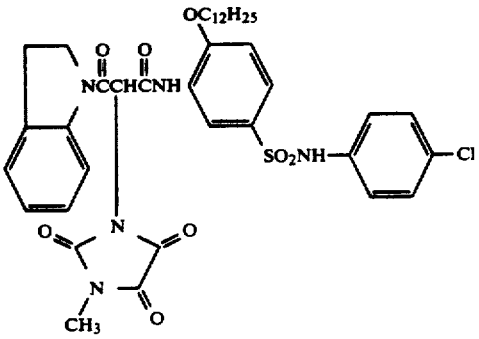
Y-53
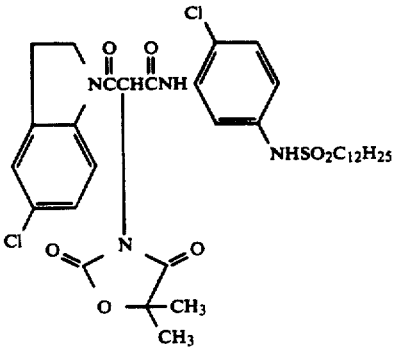
Y-54
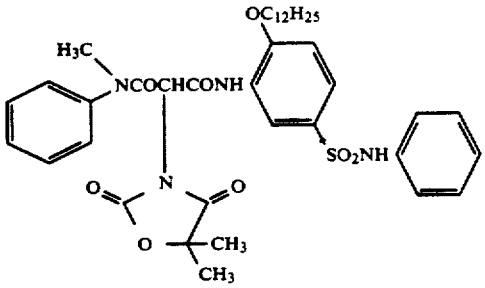
Y-55
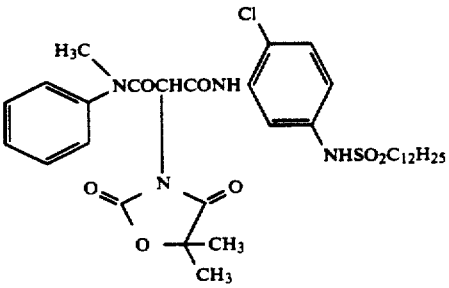
Y-56
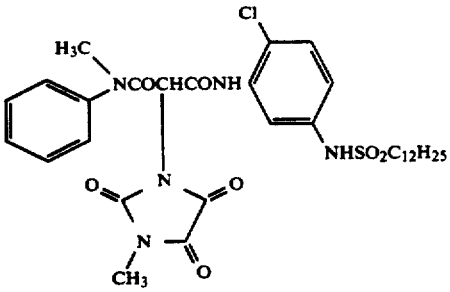
Y-57
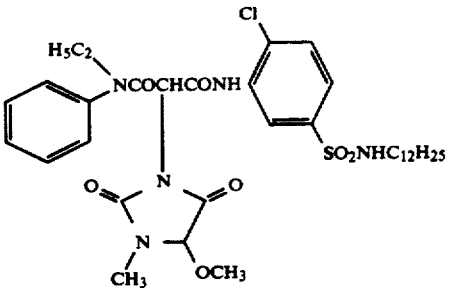
Y-58
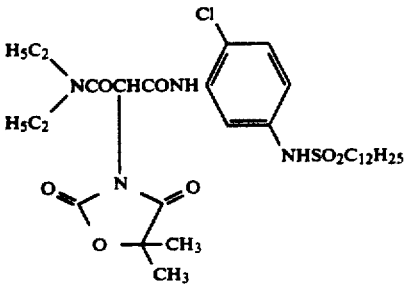
Y-59
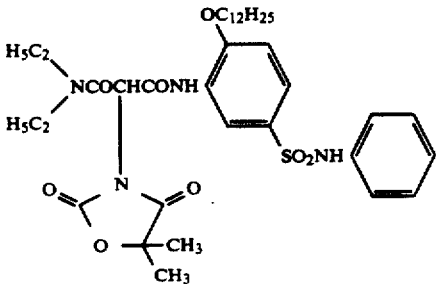

-continued
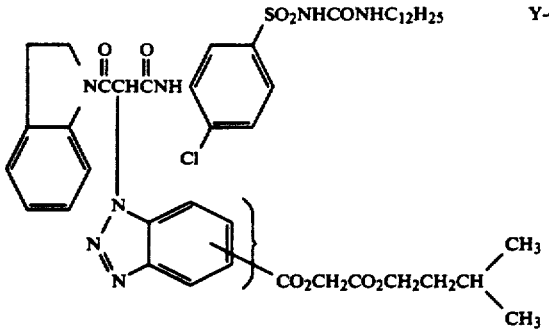
Y-60
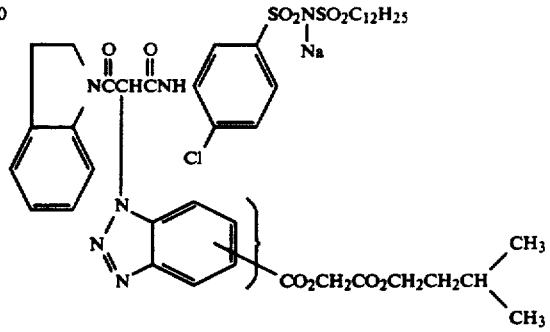
Y-61
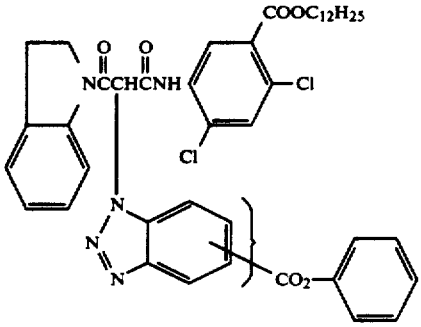
Y-62
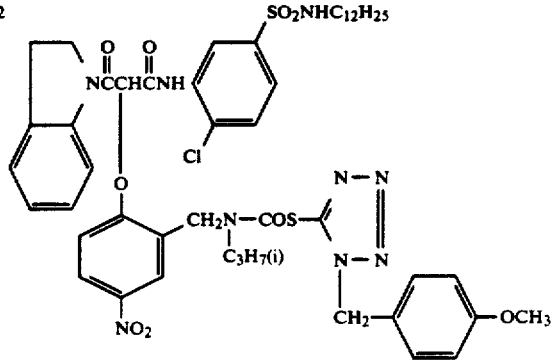
Y-63
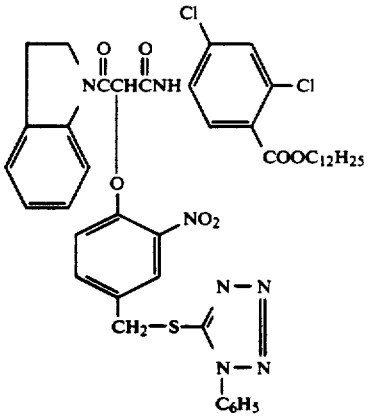
Y-64
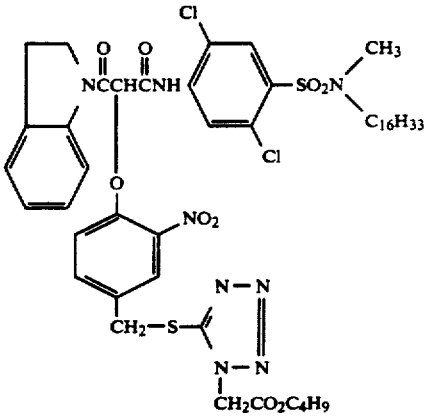
Y-65
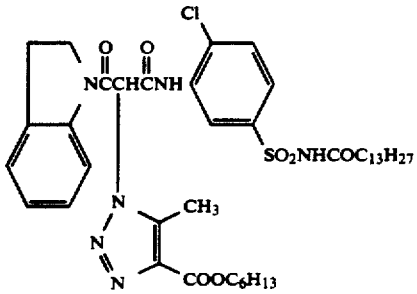
Y-66
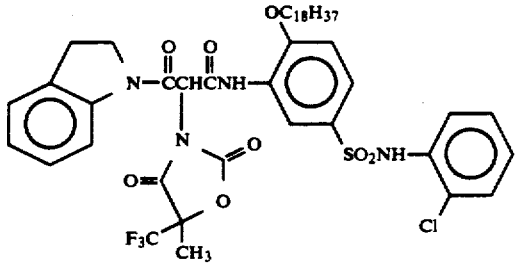
Y-67

-continued
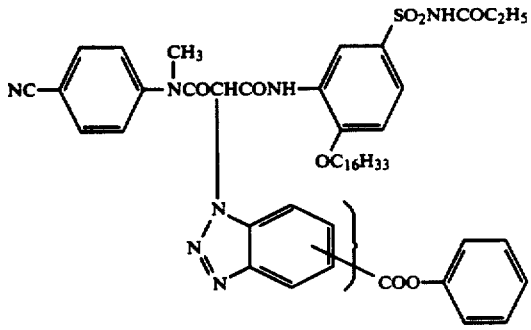
Y-68
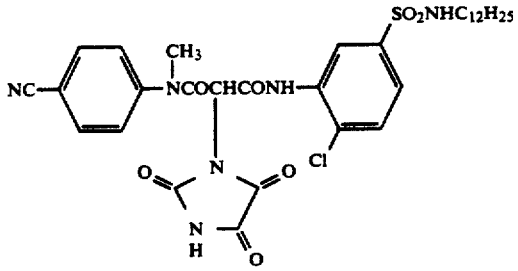
Y-69
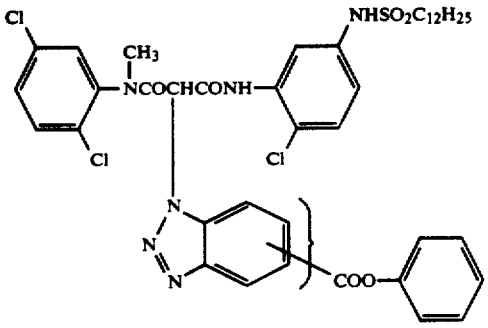
Y-70
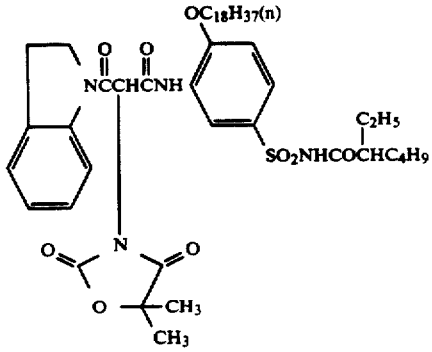
Y-71
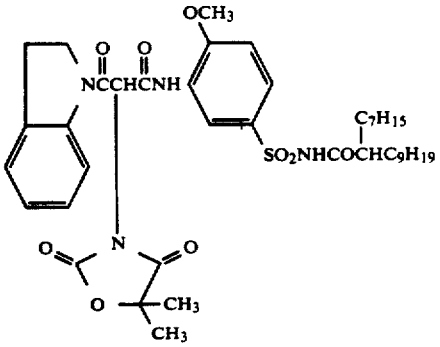
Y-72
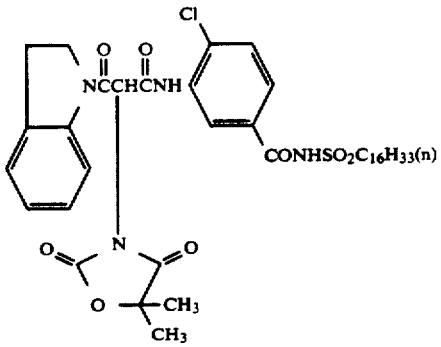
Y-73
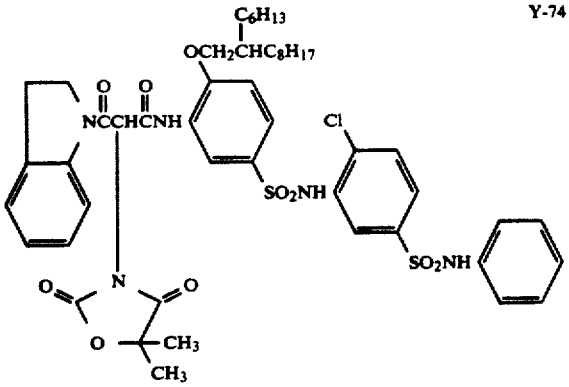
Y-74
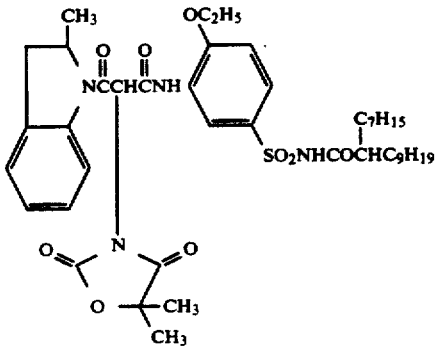
Y-75

-continued
Y-76
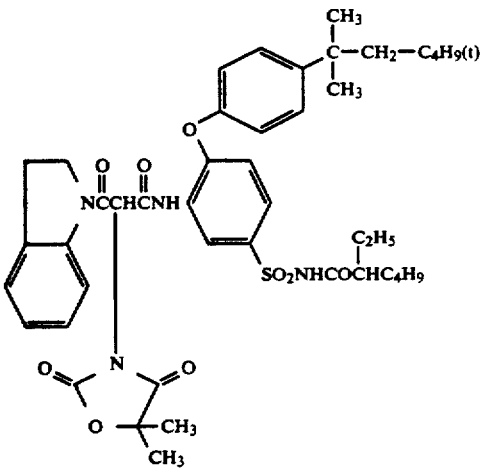
Y-77
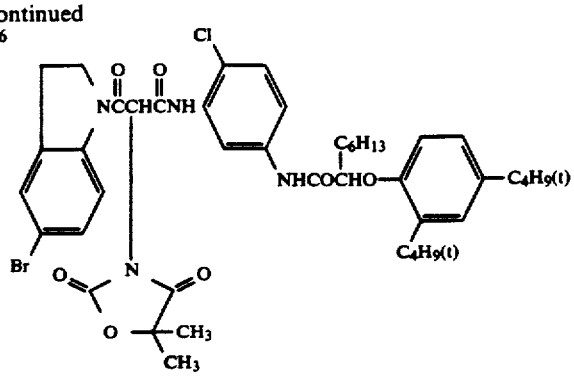
Y-78
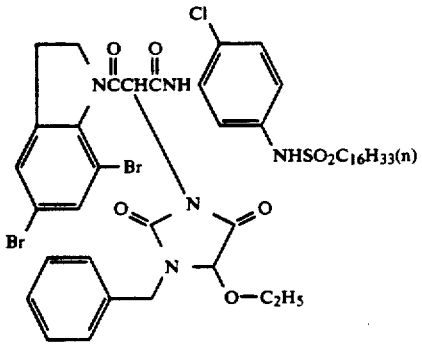
Y-79
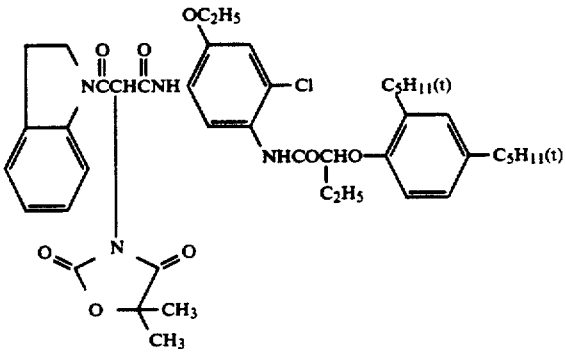
Y-80
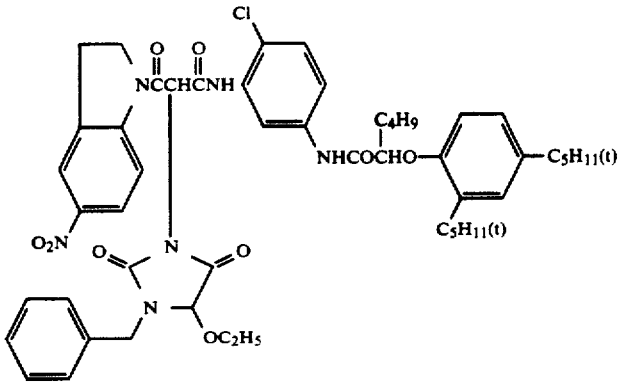
Y-81
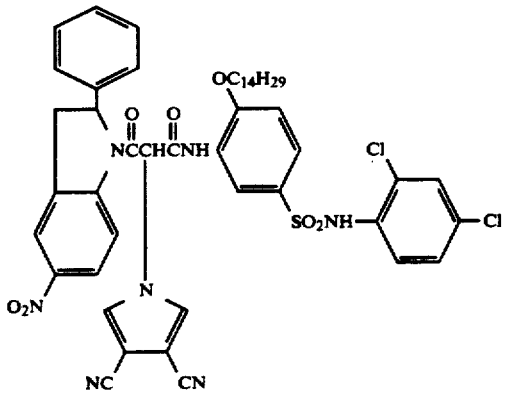
The yellow couplers represented by formulae (1) and (2) can be used as a mixture of two or more and also can The yellow coupler of the present invention is contained in the silver halide emulsion layer forming a photosensitive layer in an amount generally ranging from 0.1 to 1.0 mol, preferably 0.1 to 0.5 mol, per mol of the silver halide therein.

Now the water-insoluble polymers used in the present invention will be described.

As the water-insoluble polymers, loadable latex polymers described, for example, in U.S. Pat. No. 4,203,716, and water-insoluble and organic solvent-soluble polymers described, for example, in U.S. Pat. No. 4,857,449 and International Patent (PCT) Publication No. WO 88/00723, are preferable, with the latter being more preferable.

Examples of the water-insoluble polymer include vinyl polymers (e.g., methacrylate polymers, acrylamide polymers, and methacrylamide polymers), polyester resins obtained by condensation of a polyhydric alcohol with a polybasic acid, polycarbonate resins obtained by condensation of a glycol or a dihydric phenol with a carbonate or phosgene, polyurethane resins obtained by polyaddition of a polyhydric alcohol with a polyvalent isocyanate, and polyesters obtained by ring opening polymerization, which may be used as a mixture of two or more arbitrarily. In this specification and claims, by "water-insoluble polymer" is meant a polymer whose solubility at 25° C. in water is 10 wt % or below.

The dispersion including at least one yellow coupler represented by formula (1) or (2) together with at least one water-insoluble homopolymer or copolymer can be prepared as follows: If the polymer is a loadable latex, the yellow coupler is dissolved in a water-miscible organic solvent, and the resulting solution is mixed with the loadable latex, so that the polymer is impregnated with the yellow coupler (methods of the preparation are described in detail, for example, in U.S. Pat. No. 4,203,716). Preferably, the polymer is soluble in an organic solvent and, in this case, the yellow coupler and the polymer soluble in an organic solvent are dissolved in the organic solvent and the solution can be emulsified and dispersed in a hydrophilic binder, such as an aqueous gelatin solution (if necessary, using a surface-active agent), by a dispersing means such as a stirrer, a homogenizer, a colloid mill, a flow jet mixer, or an ultrasonic apparatus, to form a dispersion (details are described, for example, in U.S. Pat. No. 4,857,449 and International Publication Patent No. WO 88/00723).

The monomer component of the above polymer can be subjected to suspension polymerization, solution polymerization, or bulk polymerization in the presence of a photographically useful substance, such as a coupler, followed by dispersion into a hydrophilic binder in the same way as mentioned above (a detailed method is described in JP-A No. 107642/1985).

The above dispersion may contain a high-boiling organic solvent, and the high-boiling organic solvent to be used includes organic solvents that do not react with the oxidized product of a developing agent and that have a boiling point of 150° C. or over, such as phenol derivatives, phthalates, phosphates, citrates, benzoates, alkylamides, aliphatic esters, and trimesic acid esters.

To dissolve the polymer and the coupler to be used in the present invention, preferably such co-solvents as given below (low-boiling solvents and water-soluble solvents) are used.

As low-boiling organic solvents, for example, ethyl acetate, butyl acetate, ethyl propionate, secondary butyl alcohol, methyl ethyl ketone, methyl isobutyl ketone, β-ethoxyethyl acetate, methyl "Cellosolve" acetate, and cyclohexanone can be mentioned.

As water-soluble organic solvents, for example, methyl alcohol, ethyl alcohol, acetone, and tetrahydrofuran can be mentioned, which can be used as a mixture of two or more if necessary.

Although there is no particular restriction on the particle diameter of the emulsion containing the water-insoluble polymer, preferably the particle diameter is 0.04 to 2 μm, more preferably 0.06 to 0.4 μm. The particle diameter can be measured by such a measuring apparatus as a Nanosizer, made by Coulter Co., in England.

Generally the molecular weight of the polymer that can be used in the present invention is 300,000 or less, preferably 150,000 or less, more preferably 80,000 or less, and further more preferably 30,000 or less.

The weight ratio of polymer of this invention to the co-solvent is preferably in the range of from about 1:1 to 1:50. The weight ratio of the polymer of this invention to the coupler is preferably from 1:20 to 20:1, more preferably from 1:10 to 10:1.

Several specific examples of the polymer used in the present invention are given below, but the present invention is not limited to them. The ratios given in the parentheses after the copolymers are molar ratios. Specific Examples of Polymer species:

P-1) Poly(vinyl acetate)
P-2) Poly(vinyl propionate)
P-3) Polymethyl methacrylate
P-4) Polyethyl methacrylate
P-5) Polyethyl acrylate
P-6) Vinyl acetate/vinyl alcohol copolymer (95:5)
P-7) Poly-n-butyl acrylate
P-8) Poly-n-butyl methacrylate
P-9) Polyisobutyl methacrylate
P-10) Polyisopropyl methacrylate
P-11) Polydecyl methacrylate
P-12) n-Butyl acrylate/acrylamide copolymer (95:5)
P-13) Polymethyl chloroacrylate
P-14) 1,4-Butanediol adipic acid polyester
P-15) Ethylene glycol sebacic acid polyester
P-16) Polycaprolactone
P-17) Poly(2-tert-butylphenyl acrylate)
P-18) Poly(4-tert-butylphenyl acrylate)
P-19) n-Butyl methacrylate/N-vinyl-2-pyrrolidone copolymer (90:10)
P-20) Methyl methacrylate/vinyl chloride copolymer (70:30)
P-21) Methyl methacrylate/styrene copolymer (90:10)
P-22) Methyl methacrylate/ethyl acrylate copolymer (50:50)
P-23) n-Butyl methacrylate/methyl methacrylate/styrene copolymer (50:30:20)
P-24) Vinyl acetate/acrylamide copolymer (85:15)
P-25) Vinyl chloride/vinyl acetate copolymer (65:35)
P-26) Methyl methacrylate/acrylonitrile copolymer (65:35)
P-27) Diacetone acrylamide/methyl acrylate copolymer (50:50)
P-28) Vinyl methyl ketone/isobutyl methacrylate copolymer (55:45)
P-29) Ethyl methacrylate/n-butyl acrylate copolymer (70:30)
P-30) Diacetone acrylamide/n-butyl acrylate copolymer (60:40)
P-31) Methyl methacrylate/cyclohexyl methacrylate copolymer (50:50)

P-32) n-Butyl acrylate/styrene methacrylate/diacetone acrylamide copolymer (70:20:10)
P-33) N-tert-butyl methacrylamide/methyl methacrylate/acrylic acid copolymer (60:30:10)
P-34) Methyl methacrylate/styrene/vinylsulfonamide copolymer (70:20:10)
P-35) Methyl methacrylate/phenyl vinyl ketone copolymer (70:30)
P-36) n-Butyl acrylate/methyl acrylate/n-butyl methacrylate copolymer (35:35:30)
P-37) n-Butyl methacrylate/pentyl methacrylate/N-vinyl-2-pyrrolidone copolymer (38:38:24)
P-38) Methyl methacrylate/n-butyl methacrylate/isobutyl methacrylate/acrylic acid copolymer (37:29:25:9)
P-39) n-Butyl methacrylate/acrylic acid (95:5)
P-40) Methyl methacrylate/acrylic acid copolymer (95:5)
P-41) Benzyl methacrylate/acrylic acid copolymer (90:10)
P-42) n-Butyl methacrylate/methyl methacrylate/-benzyl methacrylate/acrylic acid copolymer (35:35:25:5)
P-43) n-Butyl methacrylate/methyl methacrylate/-benzyl methacrylate (35:35:30)
P-44) Poly-3-pentyl acrylate
P-45) Cyclohexyl methacrylate/methyl methacrylate/n-propyl methacrylate copolymer (37:29:34)
P-46) Polypentyl methacrylate
P-47) Methyl methacrylate/n-butyl methacrylate copolymer (65:35)
P-48) Vinyl acetate/vinyl propionate copolymer (75:25)
P-49) n-Butyl methacrylate/sodium 3-acryloxybutane-1-sulfonate copolymer (97:3)
P-50) n-Butyl methacrylate/methyl methacrylate/acrylamide copolymer (35:35:30)
P-51) n-Butyl methacrylate/methyl methacrylate/vinyl chloride copolymer (37:36:27)
P-52) n-Butyl methacrylate/styrene copolymer (90:10)
P-53) Methyl methacrylate/N-vinyl-2-pyrrolidone copolymer (90:10)
P-54) n-Butyl methacrylate/vinyl chloride copolymer (90:10)
P-55) n-Butyl methacrylate/styrene copolymer (70:30)
P-56) Poly(N-sec-butyl acrylamide)
P-57) Poly(N-tert-butyl acrylamide)
P-58) Diacetone acrylamide/methyl methacrylate copolymer (62:38)
P-59) Polycyclohexyl methacrylate/methyl methacrylate copolymer (60:40)
P-60) N-Tert-butyl acrylamide/methyl methacrylate copolymer (40:60)
P-61) Poly(N-n-butyl acrylamide)
P-62) Poly(tert-butyl methacrylate)/N-tert-butyl acrylamide copolymer (50:50)
P-63) Tert-butyl methacrylate/methyl methacrylate copolymer (70:30)
P-64) Poly(N-tert-butyl methacrylamide)
P-65) N-Tert-butyl acrylamide/methyl methacrylate copolymer (60:40)
P-66) Methyl methacrylate/acrylonitrile copolymer (70:30)
P-67) Methyl methacrylate/vinyl methyl ketone copolymer (38:62)
P-68) Methyl methacrylate/styrene copolymer (75:25)
P-69) Methyl methacrylate/hexyl methacrylate copolymer (70:30)
P-70) Poly(benzyl acrylate)
P-71) Poly(4-biphenyl acrylate)
P-72) Poly(4-butoxycarbonylphenyl acrylate)
P-73) Poly(sec-butyl acrylate)
P-74) Poly(tert-butyl acrylate)
P-75) Poly[3-chloro-2,2-bis(chloromethyl)propyl acrylate]
P-76) Poly(2-chlorophenyl acrylate)
P-77) Poly(4-chlorophenyl acrylate)
P-78) Poly(pentachlorophenyl acrylate)
P-79) Poly(4-cyanobenzyl acrylate)
P-80) Poly(cyanoethyl acrylate)
P-81) Poly(4-cyanophenyl acrylate)
P-82) Poly(4-cyano-3-thiabutyl acrylate)
P-83) Poly(cyclohexyl acrylate)
P-84) Poly(2-ethoxycarbonylphenyl acrylate)
P-85) Poly(3-ethoxycarbonylphenyl acrylate)
P-86) Poly(4-ethoxycarbonylphenyl acrylate)
P-87) Poly(2-ethoxyethyl acrylate)
P-88) Poly(3-ethoxypropyl acrylate)
P-89) Poly(1H,1H,5H-octafluoropentyl acrylate)
P-90) Poly(heptyl acrylate)
P-91) Poly(hexadeyl acrylate)
P-92) Poly(hexyl acrylate)
P-93) Poly(isobutyl acrylate)
P-94) Poly(isopropyl acrylate)
P-95) Poly(3-methoxybutyl acrylate)
P-96) Poly(2-methoxycarbonylphenyl acrylate)
P-97) Poly(3-methoxycarbonylphenyl acrylate)
P-98) Poly(4-methoxycarbonylphenyl acrylate)
P-99) Poly(2-methoxyethyl acrylate)
P-100) Poly(4-methoxyphenyl acrylate)
P-101) Poly(3-methoxypropyl acrylate)
P-102) Poly(3,5-dimethyladamantyl acrylate)
P-103) Poly(3-dimethylaminophenyl acrylate)
P-104) Poly(vinyl-tert-butyrate)
P-105) Poly(2-methylbutyl acrylate)
P-106) Poly(3-methylbutyl acrylate)
P-107) Poly(1,3-dimethylbutyl acrylate)
P-108) Poly(2-methylpentyl acrylate)
P-109) Poly(2-naphthyl acrylate)
P-110) Poly(phenyl acrylate)
P-111) Poly(propyl acrylate)
P-112) Poly(m-tolyl acrylate)
P-113) Poly(o-tolyl acrylate)
P-114) Poly(p-tolyl acrylate)
P-115) Poly(N,N-dibutyl acrylamide)
P-116) Poly(isohexyl acrylamide)
P-117) Poly((isooctyl acrylamide)
P-118) Poly(N-methyl-N-phenyl acrylamide)
P-119) Poly(adamantyl methacrylate)
P-120) Poly(benzyl methacrylate)
P-121) Poly(2-bromoethyl methacrylate)
P-122) Poly(2-N-tert-butylamioethyl methacrylate)
P-123) Poly(sec-butyl methacrylate)
P-124) Poly(tert-butyl methacrylate)
P-125) Poly(2-chloroethyl methacrylate)
P-126) Poly(2-cyanoethyl methacrylate)
P-127) Poly(2-cyanomethylphenyl methacrylate)
P-128) Poly(4-cyanophenyl methacrylate)
P-129) Poly(cyclohexyl methacrylate)
P-130) Poly(dodecyl methacrylate)
P-131) Poly(diethylaminoethyl methacrylate)
P-132) Poly(2-ethylsulfinylethyl methacrylate)

P-133) Poly(hexadecyl methacrylate)
P-134) Poly(hexyl methacrylate)
P-135) Poly(2-hydroxypropyl methacrylate)
P-136) Poly(4-methoxycarbonylphenyl methacrylate)
P-137) Poly(3,5-dimethyladamantyl methacrylate)
P-138) Poly(dimethylaminoethyl methacrylate)
P-139) Poly(3,3-dimethylbutyl methacrylate)
P-140) Poly(3,3-dimethyl-2-butyl methacrylate)
P-141) Poly(3,5,5-trimethylhexyl methacrylate)
P-142) Poly(octadecyl methacrylate)
P-143) Poly(tetradecyl methacrylate)
P-144) Poly(4-butoxycarbonylphenyl methacrylamide)
P-145) Poly(4-carboxyphenyl metacrylamide)
P-146) Poly(4-ethoxycarbonylphenyl methacrylamide)
P-147) Poly(4-methoxycarbonylphenyl methacrylamide)
P-148) Poly(butylbutoxycarbonyl methacrylate)
P-149) Poly(butyl chloroacrylate)
P-150) Poly(butyl cyanoacrylate)
P-151) Poly(cyclohexyl chloroacrylate)
P-152) Poly(ethyl chloroacrylate)
P-153) Poly(ethylethoxycarbonyl methacrylate)
P-154) Poly(ethyl ethacrylate)
P-155) Poly(ethyl fluoromethacrylate)
P-156) Poly(hexylhexyloxycarbonyl methacrylate)
P-157) Poly(isobutyl chloroacrylate)
P-158) Poly(isopropyl chloroacrylate)
P-159) Poly(p-tert-butylstyrene)
P-160) N-t-Butylacrylamide/2-methoxyethyl methacrylate) copolymer (55:45)
P-161) ω-Methoxypolyethylene glycol methacrylate (the molar addition number n=6)/methyl methacrylate (40:60)
P-162) ω-Methoxypolyethylene glycol acrylate (the molar addition number n=9)/N-t-butyl acrylamide (25:75)
P-163) Poly(2-methoxyethyl methacrylate)
P-164) Poly[2-(2-methoxyethoxy)ethyl acrylate]
P-165) 2-(2-Butoxyethoxy)ethyl acrylate/methyl methacrylate copolymer (58:42)
P-166) Poly(oxycarbonyloxy-1,4-phenyleneisobutylidene-1,4-phenylene)
P-167) Poly(oxyethyleneoxycarbonyliminohexamethyleneiminocarbonyl)
P-168) N-[4-(4'-Hydroxyphenylsulfonyl)phenyl]acrylamide/butyl acrylate copolymer (65:35)
P-169) N-(4-hydroxyphenyl)methacrylamide/N-t-butyl acrylamide copolymer (50:50)
P-170) [4-(4'-Hydroxylphenylsulfonyl)phenoxymethyl]styrene (m/p mixture)/N-t-butyl acrylamide copolymer (15:85)
P-171) Poly(N,N-dimethyl acrylamide)
P-172) Poly(N-t-butyl methacrylamide)
P-173) Polyoctyl acrylate
P-174) Polycaprolactam
P-175) Polypropiolactam
P-176) Polydimethylpropiolactone
P-177) Stearyl methacrylate/acrylic acid copolymer (90:10)
P-178) Stearyl methacrylate/methyl methacrylate/acrylic acid copolymer (50:40:10)
P-179) Butyl acrylate/styrene methacrylate/diacetone acrylamide copolymer (70:20:10)
P-180) N-t-Butyl acrylamide/methylphenyl methacrylate copolymer (60:40)
P-181) N-t-Butyl methacrylamide/vinylpyridine copolymer (95:5)
P-182) Diethyl maleate/butyl acrylate copolymer (65:35)

Among polymers above-mentioned, (P-3), (P-7), (P-8), (P-14), (P-21), (P-23), (P-45), (P-57), (P-68), (P-69), (P-129), (P-159), (P-172), (P-1), (P-180), and (P-181) are preferable, and (P-3), (P-21), (P-57), (P-129), (P-172), and (P-180) are more preferable.

Although, as a silver halide used in the present invention, for example, silver chloride, silver bromide, silver bromo(iodo)chloride, and silver bromoiodide can be used, particularly if rapid processing is intended, a silver chloride emulsion or a silver bromochloride emulsion substantially free from silver iodide and having a silver chloride content of 90 mol % or more, preferably 95 mol % or more, particularly preferably 98 mol % or more, is used preferably.

In the photographic material according to the present invention, in order to improve, for example, sharpness of the image, preferably a dye that can be decolored by processing (in particular an oxonol dye), as described in European Patent EP 0,337,490A2, pages 27 to 76, is added to a hydrophilic layer, so that the optical reflection density of the photographic material at 680 nm may be 0.70 or over, or 12 wt % or more (preferably 14 wt % or more) of titanium oxide the surface of which has been treated with secondary to quaternary alcohol (e.g., trimethylolethane) or the like is contained in a water-resistant resin layer of the support.

As a high-boiling organic solvent for photographic additives, such as cyan and magenta couplers that can be used in the present invention, any compound can be used if the compound has a melting point of 100° C. or below and a boiling point of 140° C. or higher; if it is immiscible with water; and if it is a good solvent for the coupler. The melting point of the high-boiling organic solvent is preferably 80° C. or below and the boiling point of the high-boiling organic solvent is preferably 160° C. or higher, more preferably 170° C. or higher.

Details of these high-boiling organic solvents are described in JP-A No. 215272/1987, from page 137 (right lower column) to page 144 (right upper column).

The cyan coupler or magenta coupler can be emulsified and dispersed into a hydrophilic colloid, by impregnating into a loadable latex polymer (e.g., see U.S. Pat. No. 4,203,716) in the presence or absence of the above high-boiling organic solvent or by dissolving into a polymer insoluble in water but soluble in organic solvents.

Preferably, homopolymers and copolymers described in U.S. Pat. No. 4,857,449 (from 7th to 15th columns) and International Publication WO 88/00723, pages 12 to 30, are used, and more preferably methacrylate polymers or acrylamide polymers, particularly preferably acrylamide polymers, are used because, for example, the color image is stabilized.

In the photographic material according to the present invention, preferably together with the coupler a color image preservability-improving compound, as described in European Patent EP 0,277,589A2, is used. Particularly a combination with a pyrazoloazole coupler is preferable.

That is, when a compound (F), which will chemically combine with the aromatic amine developing agent remaining after the color development processing to form a chemically inactive and substantially colorless compound, and/or a compound (G), which will chemically combine with the oxidized product of the aromatic amine color developing agent remaining after the color development processing to form a chemically inactive and substantially colorless compound, are used simultaneously or singly, it is preferable because occurrence of stain and other side effects, for example, due to the production of a color-formed dye by reaction of the coupler with the color-developing agent or its oxidized product remaining in the film during the storage after the processing, can be prevented.

To the photographic material according to the present invention, a mildew-proofing agent described, for example, in JP-A No. 271247/1988, is preferably added in order to prevent the growth of a variety of mildews and fungi that will propagate in the hydrophilic layer and deteriorate the image thereon.

As a support to be used for the photographic material of the present invention, a white polyester support for display may be used, or a support wherein a layer containing white pigment is provided on the side that will have a silver halide layer. Further, in order to improve sharpness, preferably an anti-halation layer is applied on the side of the support where the silver halide layer is applied or on the undersurface of the support. In particular, preferably the transmission density of the base is set in the range of 0.35 to 0.8, so that the display can be appreciated through either reflected light or transmitted light.

The photographic material of the present invention may be exposed to visible light or infrared light. The method of exposure may be low-intensity exposure or high-intensity short-time exposure, and particularly in the later case, the laser scan exposure system, wherein the exposure time per picture element is less than $10^{-4}$ sec is preferable.

When exposure is carried out, the band stop filter, described in U.S. Pat. No. 4,880,726, is preferably used. Thereby light color mixing is eliminated and the color reproduction is remarkably improved.

The exposed photographic material may be subjected to conventional color development processing, and then preferably it is subjected to bleach-fix processing for the purpose of rapid processing. In particular, when the above-mentioned high-silver-chloride emulsion is used, the pH of the bleach-fix solution is preferably about 6.5 or below, more preferably about 6 or below, for the purpose of he acceleration of desilvering.

With respect to silver halide emulsions, other materials (e.g., additives) and photographic component layers (e.g., layer arrangement) that will be applied to the photographic material of the present invention, as well as processing methods and processing additives that will be applied to the photographic material of the present invention, particularly those described in below-mentioned patent publications, particularly in European Patent EP 0,355,660A2 (JP-A No. 139544/1990), are preferably used.

| Element constituting photographic material | JP-A No. 215272/1987 | JP-A No. 33144/1990 | EP 0,355,660A2 |
|---|---|---|---|
| Silver halide emulsion | p. 10 upper right column line 6 to p. 12 lower left column line 5, and p. 12 lower right column line 4 from the bottom to p. 13 upper left column line 17 | p. 28 upper right column line 16 to p. 29 lower right column line 11 and p. 30 lines 2 to 5 | p. 45 line 53 to p. 47 line 3 and p. 47 lines 20 to 22 |
| Solvent for silver halide | p. 12 lower left column line 6 to 14 and p. 13 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 38 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magent, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthen agent | p. 121 upper left column line 7 to p. 125 upper right column line 1 | — | — |
| Ultra violet absorbent | p 125 upper right column line 2 to p. 127 lower left column last line | p. 37 lower right column line 14 to p. 38 upper left column line 11 | p. 65 lines 22 to 31 |
| Discoloration inhibitor | p. 127 lower right column line 1 to p. 137 lower | p. 36 upper right column line 12 to p. 37 upper | p. 4 line 30 to p. 5 line 23, |

-continued

| Element constituting photographic material | JP-A No. 215272/1987 | JP-A No. 33144/1990 | EP 0,355,660A2 |
|---|---|---|---|
| (Image-dye stabilizer) | left column line 8 | left column line 19 | p. 29 line 1 to p. 45 line 25 p. 45 lines 33 to 40 and p. 65 lines 2 to 21 |
| High-boiling and/or low-boiling solvent | p. 137 lower left column line 9 to p. 144 upper right column last line | p. 35 lower right column line 14 to p. 36 upper left column line 4 | p. 64 lines 1 to 51 |
| Method for dispersing additives for photograph | p. 144 lower left column line 1 to p. 146 upper right column line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left column line 4 | — | — |
| Developing Agent precursor | p. 155 lower left column line 5 to p. 155 lower right column line 2 | — | — |
| Compound releasing development restrainer | p. 155 lower right column lines 3 to 9 | — | — |
| Base | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layer | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower right column last line | p. 38 upper left column line 12 to upper right column line 7 | p 66 lines 18 to 22 |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor | p. 188 lower right column line 9 to p. 193 lower right column line 10 | p. 37 upper left column last line to lower right column line 13 | p. 65 line 32 to p. 66 line 1 |
| Surface-active agent | p. 201 lower left column line 1 to p. 210 upper right column last line | p. 18 upper right column line 1 to p. 24 lower right column last line and p. 27 lower left column line 10 from the bottom to lower right column line 9 | — |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | — |
| Binder (Hydrophilic colloid) | p. 222 lower left column line 6 to p. 225 upper left column last line | p. 38 upper right column lines 8 to 18 | p. 66 lines 23 to 28 |
| Thickening agent | p. 225 upper right column line 1 to p. 227 upper right column line 2 | — | — |
| Antistatic agent | p. 227 upper right column line 3 to p. 230 upper left column line 1 | — | — |
| Polymer latex latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note:
In the cited part of JP-A No. 21572/1987, amendment filed on March 16, 1987 is included.

Further, as cyan couplers for combination use, diphenylimidazole series cyan couplers described in JP-A As a method for color development processing of a photographic material using a high-silver-chloride emulsion having a silver chloride content of 90 mol % or more, the method described in, for example, JP-A No. 207250/1990, page 27 (the left upper column) to page 34 (the right upper column), is preferably used.

According to the present invention, a silver halide color photographic material can be obtained which is excellent in storage stability after the production and which is improved in color reproduction of the yellow dye image and the balance of light-fading and dark-fading of the yellow dye image.

The present invention will be described in more detail in accordance with Examples, but the invention is not limited to these Examples.

EXAMPLE 1

A multilayer color print paper (Sample A-1) having layer compositions shown below was prepared on a paper support laminated on both sides thereof with polyethylene film, subjected to a corona discharge on the surface, and provided a gelatin prime coat-layer containing sodium dodecylbenzenesulphonate. Coating solutions were prepared as follows:

Preparation of the First Layer Coating Solution

To a mixture of 19.1 g of yellow coupler (ExY-1), 4.0 g of polymer (P-57), and 0.24 g of image-dye stabilizer (Cpd-6) were added and dissolved 27.2 ml of ethyl acetate and each 4.1 g of solvent (Solv-3) and solvent (Solv-7). The resulting solution was dispersed and emulsified in 185 ml of 10% aqueous gelatin solution containing 8 ml of sodium dodecylbenzenesulfonate, thereby prepared emulsified dispersion A. Separately silver chlorobromide emulsion A (cubic grains, 3:7 (silver molar ratio) blend of large size grain emulsion A and small size grain emulsion A having 0.88 μm and 0.70 μm of average grain size, the deviation coefficients of which grain size were 0.08 and 0.10, respectively, each in which 0.3 mol % of silver bromide was located at the surface of grains) was prepared. Blue-sensitive sensitizing dyes A and B, shown below, were added in this emulsion in such amounts of $2.0\times10^{-4}$ mol to the large size emulsion A and $2.5\times10^{-4}$ mol to the small size emulsion B, per mol of silver, respectively. The chemical ripening was carried out by adding sulfur and gold sensitizing agents. The above-described emulsified dispersion A and this emulsion A were mixed together and dissolved to give the composition shown below, thereby preparing the first layer coating solution. Coating solutions for the second to the seventh layer were also prepared in the same manner as the first layer coating solution. As a gelatin hardener for the respective layers, 1-hydroxy-3,5-dichloro-s-triazine sodium salt was used.

As spectral-sensitizing dyes for the respective yers, the following compounds were used:

Sensitizing dye A for yellow color-forming emulsion layer

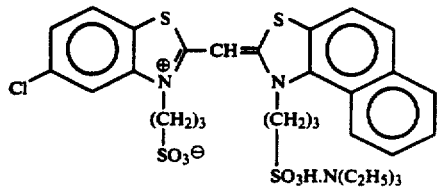

Sensitizing dye B for yellow color-forming emulsion layer

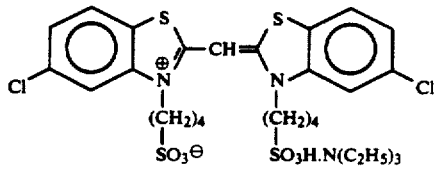

(each $2.0\times10^{-4}$ mol to the large size emulsion A and $2.5\times10^{-4}$ mol to the small size emulsion A, per mol of silver halide.)

Sensitizing dye C for magenta color-forming emulsion layer

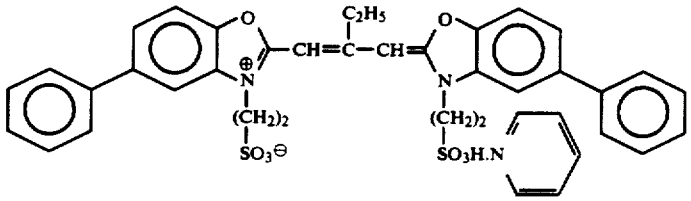

($4.0\times10^{-4}$ mol to the large size emulsion B and $5.6\times10^{-4}$ mol to the small size emulsion B, per mol of silver halide)

Sensitizing dye D for magenta color-forming emulsion layer

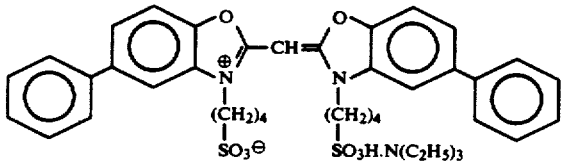

($7.0\times10^{-5}$ mol to the large size emulsion and $1.0\times10^{-5}$ mol to the small size emulsion, per mol of silver halide)

Sensitizing dye E for cyan color-forming emulsion layer

-continued

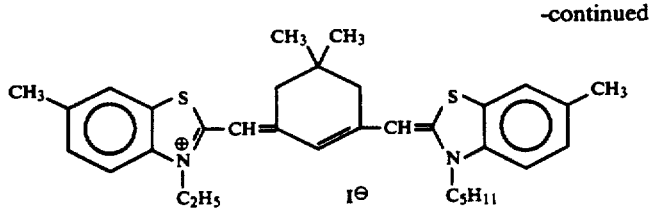

($0.9\times10^{-4}$ mol to the large size emulsion C and $1.1\times10^{-4}$ mol to the small size emulsion C, per mol of silver halide)

To the red-sensitive emulsion layer, the following compound was added in an amount of $2.6\times10^{-3}$ mol per mol of silver halide:

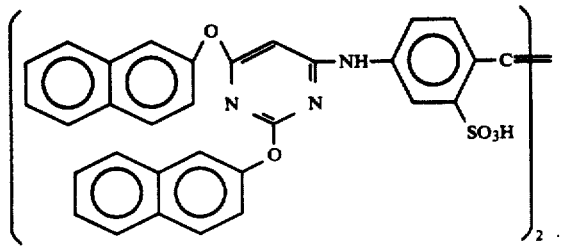

Further, 1-(5-methylureidophenyl)-5-mercaptotetrazole was added to the yellow color-forming emulsion layer, the magenta color-forming emulsion layer, and the cyan color-forming emulsion layer in amount of $8.5\times10^{-5}$ mol, $7.0\times10^{-4}$ mol, and $2.5\times10^{-4}$ mol, per mol of silver halide, respectively.

Further, 4-hydroxy-6-methyl-1,3,3*a*,7-tetrazaindene was added to the yellow color-forming emulsion layer and the magenta color-forming emulsion layer in amount of $1\times10^{-4}$ mol and $2\times10^{-4}$ mol, per mol of silver halide, respectively.

The dyes shown below (figure in parentheses represents coating amount) were added to the emulsion layers for prevention of irradiation.

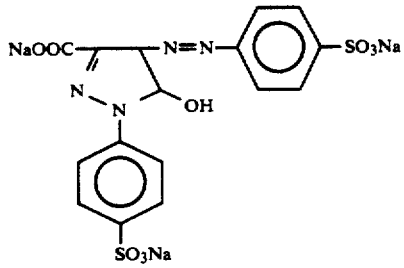

(10 mg/m²)

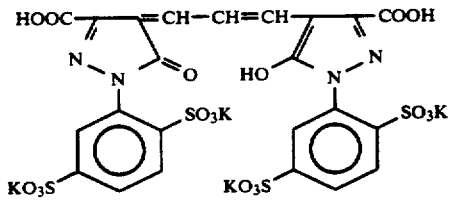

(10 mg/m²)

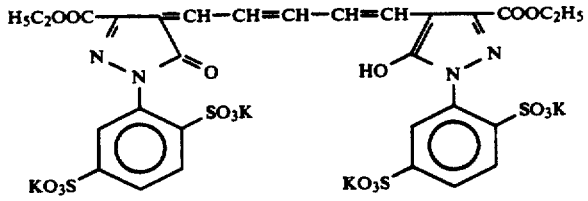

(40 mg/m²)

and

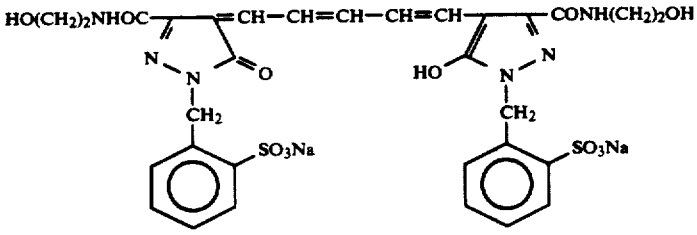

(20 mg/m²)

Composition of Layers

The composition of each layer is shown below. The figures represent coating amount (g/m²). The coating amount of each silver halide emulsion is given in terms of silver.

Supporting Base

Paper laminated on both sides with polyethylene (a white pigment, $TiO_2$, and a bluish dye, ultramarine, were included in the first layer side of the polyethylene-laminated film)

| | |
|---|---|
| First Layer (Blue-sensitive silver halide emulsion layer) | |
| The above described silver chlorobromide emulsion A | 0.30 |
| Gelatin | 1.22 |
| Yellow coupler (ExY-1) | 0.82 |
| Polymer (P-57) | 0.17 |
| Solvent (Solv-3) | 0.18 |
| Solvent (Solv-7) | 0.18 |
| Image-dye stabilizer (Cpd-6) | 0.01 |
| Second Layer (Color-mix preventing layer) | |
| Gelatin | 0.64 |
| Color-mix inhibitor (Cpd-4) | 0.10 |
| Solvent (Solv-1) | 0.16 |
| Solvent (Solv-4) | 0.08 |
| Third Layer (Green-sensitive silver halide emulsion layer) | |
| Silver chlorobromide emulsions (cubic grains, 1:3 (Ag mol ratio) blend of large size emulsion having average grain size of 0.55 μm and small size emulsion having average grain size of 0.39 μm, each of whose deviation coefficient of grain size distribution is 0.10 and 0.08, respectively, each in which 0.8 mol % of AgBr was located at the surface of grains) | 0.12 |
| Gelatin | 1.28 |
| Magenta coupler (ExM) | 0.23 |

-continued

| | |
|---|---|
| Image-dye stabilizer (Cpd-1) | 0.03 |
| Image-dye stabilizer (Cpd-2) | 0.16 |
| Image-dye stabilizer (Cpd-3) | 0.02 |
| Image-dye stabilizer (Cpd-8) | 0.02 |
| Solvent (Solv-2) | 0.40 |
| Fourth Layer (Ultraviolet rays-absorbing layer) | |
| Gelatin | 1.41 |
| Ultraviolet-absorber (UV-1) | 0.47 |
| Color-mix inhibitor (Cpd-4) | 0.05 |
| Solvent (Solv-5) | 0.24 |
| Fifth Layer (Red-sensitive silver halide emulsion layer) | |
| Silver chlorobromide emulsions (cubic grains, 1:4 (Ag mol ratio) blend of large size emulsion having average grain size of 0.58 μm and small size emulsion having average grain size of 0.45 μm, each of whose deviation coefficient of grain size distribution is 0.09 and 0.11, respectively, each in which 0.6 mol % of AgBr was located at the surface of grains) | 0.23 |
| Gelatin | 1.04 |
| Cyan coupler (ExC) | 0.32 |
| Image-dye stabilizer (Cpd-1) | 0.03 |
| Image-dye stabilizer (Cpd-3) | 0.02 |
| Image-dye stabilizer (Cpd-5) | 0.18 |
| Image-dye stabilizer (Cpd-6) | 0.40 |
| Image-dye stabilizer (Cpd-7) | 0.05 |
| Solvent (Solv-6) | 0.14 |
| Sixth layer (Ultraviolet rays-absorbing layer) | |
| Gelatin | 0.48 |
| Ultraviolet absorber (UV-1) | 0.16 |
| Color-mix inhibitor (Cpd-4) | 0.02 |
| Solvent (Solv-5) | 0.08 |
| Seventh layer (Protective layer) | |
| Gelatin | 1.10 |
| Acryl-modified copolymer of polyvinyl alcohol (modification degree: 17%) | 0.17 |
| Liquid paraffin | 0.03 |

Compounds used are as follows:

Comparative Yellow coupler

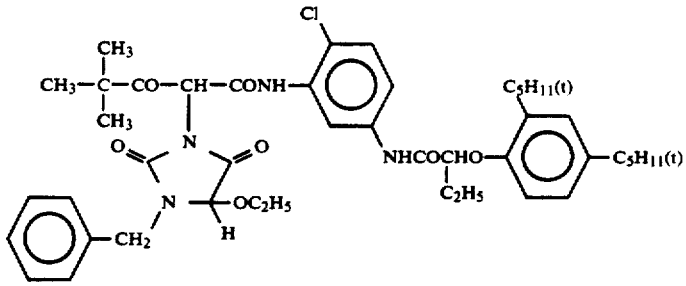

(ExY-1)

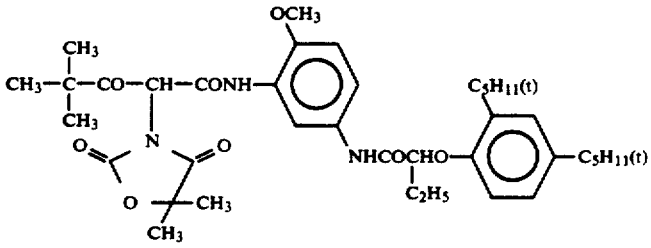

(ExY-2)

Magenta coupler

-continued
(ExM)
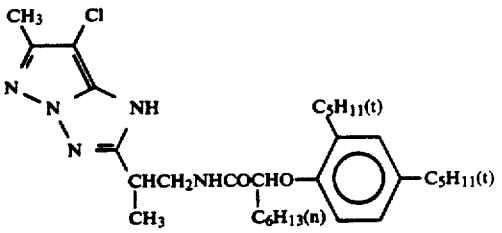
Cyan coupler
Mixture (2:3:5 in molar ratio) of
(ExC)
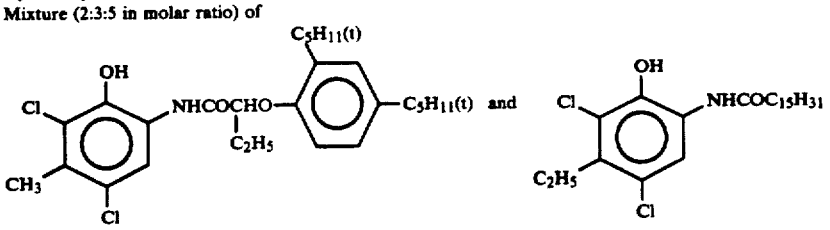
Image-dye stabilizer
(Cpd-1)
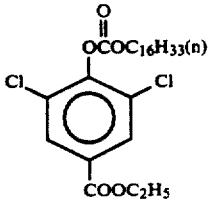
Image-dye stabilizer
(Cpd-2)
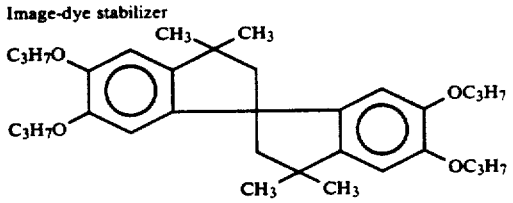
Image-dye stabilizer
(Cpd-3)
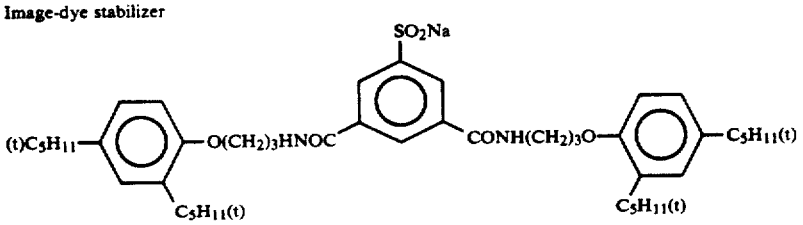
Color-mix inhibitor
(Cpd-4)
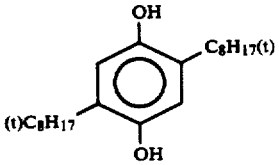
Image-dye stabilizer
Mixture (2:4:4 in weight ratio) of
(Cpd-5)
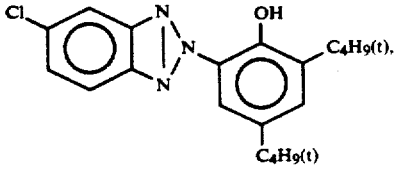

-continued
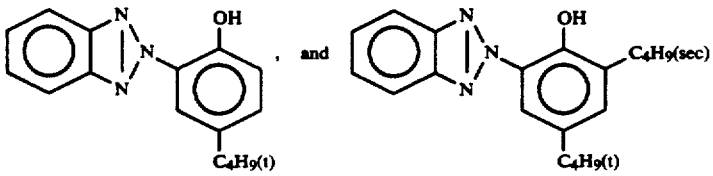
Image-dye stabilizer (Cpd-6)
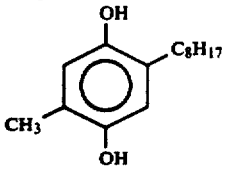
Image-dye stabilizer
Mixture (1:1 in weight ratio) of (Cpd-7)
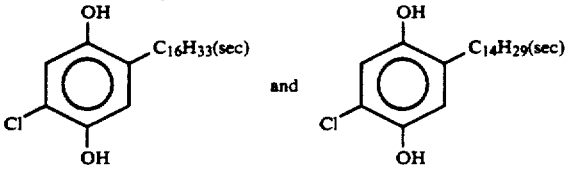
Image-dye stabilizer (Cpd-8)
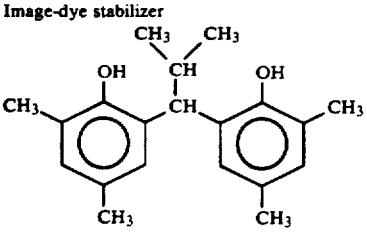
Antiseptic (Cpd-9)
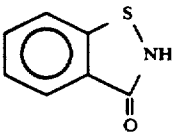
Antiseptic (Cpd-10)
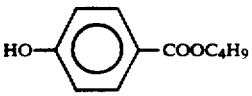
Ultraviolet ray absorber
Mixture (4:2:4 in weight ratio) of (UV-1)
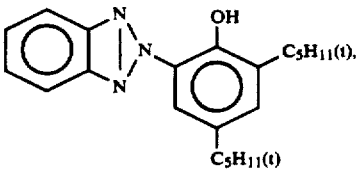
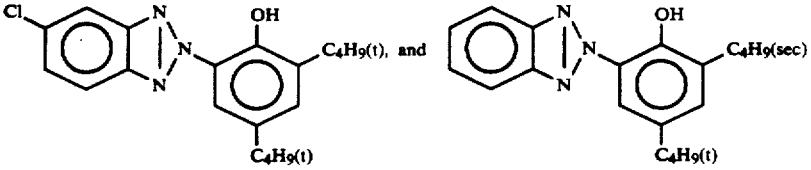
Solvent -continued

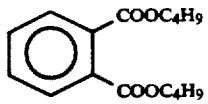

(Solv-1)

Solvent
Mixture (1:1 in volume ratio) of

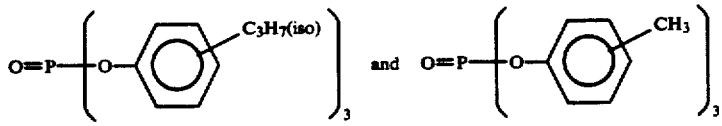

(Solv-2)

Solvent
$O{=}P{+}O{-}C_9H_{19}(iso)]_3$ (Solv-3)

Solvent

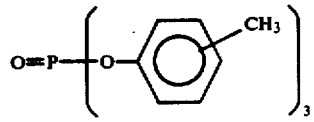

(Solv-4)

Solvent

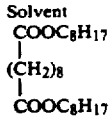

(Solv-5)

Solvent
Mixture (80:20 in volume ratio of

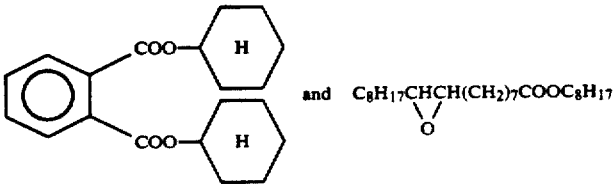

(Solv-6)

Solvent

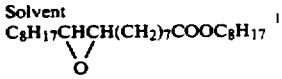

(Solv-7)

Samples (A-2) and (A-3) for comparison and Samples (A-4) to (A-11) of this invention were prepared in the same manner as Sample (A-1), except that the yellow coupler and polymer in the first layer were changed. Further, Samples (B-1) to (B-9) in which polymer was not contained were prepared for comparison.

Each of Samples prepared as described above was subjected to an exposure to light and to a processing, shown below.

First, each of samples was subjected to a gradation exposure to light through three color separated filter for sensitometry using a sensitometer (FWH model made by Fuji Photo Film Co., Ltd., the color temperature of light source was 3200K). At that time, the exposure was carried out in such a manner that the exposure amount was 250 CMS with the exposure time being 0.1 sec.

After exposure to light, each sample was processed according to the following processing process and processing solutions using a paper processor.

| Processing step | Temperature | Time | Replenisher* | Tank Volume |
|---|---|---|---|---|
| Color developing | 35° C. | 45 sec | 161 ml | 17 liter |
| Bleach-fixing | 30–35° C. | 45 sec | 215 ml | 17 liter |
| Rinse (1) | 30–35° C. | 20 sec | — | 10 liter |

-continued

| Processing step | Temperature | Time | Replenisher* | Tank Volume |
|---|---|---|---|---|
| Rinse (2) | 30–35° C. | 20 sec | — | 10 liter |
| Rinse (3) | 30–35° C. | 20 sec | 350 ml | 10 liter |
| Drying | 70–80° C. | 60 sec | | |

Note:
*Replenisher amount per $m^2$ of photographic material. Rinsing steps were carried out in 3-tanks countercurrent mode from the tank of rinsing (3) toward the tank of rinsing (1).

The composition of each processing solution is as followed, respectively:

| Color-developer | Tank Solution | Replenisher |
|---|---|---|
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-Bis(carboxymethyl)hydrazine | 4.0 g | 5.0 g |
| Monosodium N,N-di(sulfoethyl)- | 4.0 g | 5.0 g |

-continued

| | | |
|---|---|---|
| hydroxylamine | | |
| Fluorescent whitening agent (WHITEX-4B, made by Sumitomo Chemical Ind.) | 1.0 g | 2.0 g |
| Water to make | 1000 ml | 1000 ml |
| pH (25° C.) | 10.05 | 10.45 |
| **Bleach-fixing solution (Both tank solution and replenisher)** | | |
| Water | 400 ml | |
| Ammonium thiosulfate (70 g/l) | 100 ml | |
| Sodium sulfite | 17 g | |
| Iron (III) ammonium ethylenediamine-tetraacetate dihydrate | 55 g | |
| Disodium ethylenediaminetetraacetate | 5 g | |
| Ammonium bromide | 40 g | |
| Water to make | 1000 ml | |
| pH (25°) | 6.0 | |
| **Rinse solution (Both tank solution and replenisher)** | | |
| Ion-exchanged water (calcium and magnesium each are 3 ppm or below) | | |

With respect to the wet-and-heat fastness and light fastness of yellow color image of each processed sample, the following test was conducted.

Wet-and-Heat Fastness

Each sample was allowed to stand for 20 days in a dark place conditioned at 80° C. and 70% R.H., and then the decrement of yellow color density of initial density 1.5 was determined.

Light Fastness

Each sample was mounted on a sun light fading disk and irradiated by sun light for 3 months in a solar house, and then the decrement of yellow color density of initial density 1.5 was determined.

Results are shown in Table 1.

TABLE 1

| Sample | Coupler | Polymer | Dark-fading (%) | Light-fading (%) | Remarks |
|---|---|---|---|---|---|
| A-1 | ExY-1 | P-57 | 25 | 13 | Comparison |
| A-2 | ExY-1 | P-3 | 25 | 14 | " |
| A-3 | ExY-2 | P-8 | 25 | 14 | " |
| A-4 | Y-1 | P-3 | 14 | 12 | This Invention |
| A-5 | Y-6 | P-5 | 15 | 12 | " |
| A-6 | Y-6 | P-21 | 14 | 13 | " |
| A-7 | Y-17 | P-57 | 12 | 13 | " |
| A-8 | Y-36 | P-23 | 12 | 14 | " |
| A-9 | Y-37 | P-14 | 13 | 11 | " |
| A-10 | Y-38 | P-3 | 11 | 10 | " |
| A-11 | Y-38 | P-8 | 12 | 12 | " |
| A-12 | Y-39 | P-57 | 13 | 11 | " |
| A-13 | Y-39 | P-68 | 11 | 13 | " |
| A-14 | Y-56 | P-57 | 14 | 12 | " |
| B-1 | ExY-1 | — | 24 | 19 | Comparison |
| B-2 | ExY-2 | — | 25 | 18 | " |
| B-3 | Y-6 | — | 18 | 20 | " |
| B-4 | Y-17 | — | 16 | 19 | " |
| B-5 | Y-36 | — | 16 | 20 | " |
| B-6 | Y-37 | — | 17 | 19 | " |
| B-7 | Y-38 | — | 15 | 21 | " |
| B-8 | Y-39 | — | 16 | 20 | " |
| B-9 | Y-56 | — | 20 | 21 | " |

Note:
1. Each coupler in Samples A-2 to B-9 was used in the same molar amount as Sample A-1.
2. Each coating amount of polymer in Sample A-2 to A-14 was the same molar amount as Sample A-1.
3. Coupler: Exemplified compound
4. Polymer: Exemplified compound As is apparent from Table 1, in the cases of Comparative Samples (A-1) to (A-3) and (B-1) to (B-2), wherein conventional yellow couplers are used, improvement in dark-fading that can be obtained by the use of polymers of the present invention cannot be observed. On the other hand, in the cases wherein yellow couplers of the present invention are used, the dark-fading ratio of Samples (A-4) to (A-14), wherein polymers of this invention are used, is apparently lowered in comparison with Comparative Samples (B-3) to (B-9), and therefore it can be understood that the Samples of this invention are improved in preservability of yellow dye images under humidity and heat in darkness. Further it can be understood that, in comparison with the Comparative Samples, the Samples of this invention are remarkably improved also in light fastness of yellow dye images by the use of polymers of this invention.

EXAMPLE 2

A coating solution similar to the coating solution of the first layer of Example 1 was prepared in the same procedure of preparing the first layer of Example 1 using the same composition of the coating solution of the first layer of Example 1, except that only the amount of the polymer was changed to 2.0 g. A silver halide photographic material (C-1) having the same layer constitution and base as those of Example 1 was prepared, except that the thus prepared coating solution for a first layer was used.

Samples (C-2) and (C-14) for comparison and Samples (C-3) to (C-13) of this invention were prepared in the same manner as that for Sample (C-1), except that the kind of yellow coupler used and the kind of image stabilizer used were changed.

After the preparation, the above Samples and Comparative Samples (B-1) to (B-9) were kept for 1 week under conditions of 50° C. and 60% RH and then were subjected to continuous graduation exposure to light and were processed under the same conditions as above. With respect to these Samples, sensitometry evaluation was carried out to determine the change in sensitivity after the storage. The change in sensitivity was defined as the value $E=100\times(1-E/E_{FR})$, wherei $E_{FR}$ is the exposure amount giving a density of 0.5 for the Sample immediately after the preparation, and E is the exposure amount giving a density of 0.5 for the Sample after the storage for 1 week. Where the E value is positive, it shows that the sensitivity has been increased after the storage and that the greater the positive value is, the greater the degree of the change in sensitivity is. The results are shown in Table 2.

TABLE 2

| Sample | Coupler (Eemplified compound) | Image-dye stabilizer (Exemplified compound) | ΔE (Change of Sensitivity) | |
|---|---|---|---|---|
| C-1 | ExY-1 | P-3 | 13 | Comparison |
| C-2 | ExY-2 | P-57 | 14 | " |
| C-3 | Y-6 | P-3 | 9 | This Invention |
| C-4 | Y-6 | P-57 | 10 | " |
| C-5 | Y-17 | P-57 | 8 | " |
| C-6 | Y-36 | P-3 | 8 | " |
| C-7 | Y-36 | P-57 | 7 | " |
| C-8 | Y-37 | P-3 | 9 | " |
| C-9 | Y-38 | P-3 | 8 | " |
| C-10 | Y-38 | P-57 | 9 | " |
| C-11 | Y-39 | P-3 | 9 | " |
| C-12 | Y-39 | P-57 | 8 | " |
| C-13 | Y-56 | P-57 | 10 | |
| C-14 | Y-6 | Comparative compound 1 | 18 | Comparison |
| B-1 | ExY-1 | — | 13 | " |

TABLE 2-continued

| Sample | Coupler (Exemplified compound) | Image-dye stabilizer (Exemplified compound) | ΔE (Change of Sensitivity) | |
|---|---|---|---|---|
| B-2 | ExY-2 | — | 15 | " |
| B-3 | Y-6 | — | 15 | " |
| B-4 | Y-17 | — | 16 | " |
| B-5 | Y-36 | — | 14 | " |
| B-6 | Y-37 | — | 16 | " |
| B-7 | Y-38 | — | 15 | " |
| B-8 | Y-39 | — | 17 | " |
| B-9 | Y-56 | — | 17 | " |

Note:
1. Each coupler in Samples A-2 to B-9 was used in the same molar amount as Sample A-1.
2. Each image-dye stabilizer in Sample A-2 to A-13 was used in the same coating amount as A-1.

Comparative Compound 1

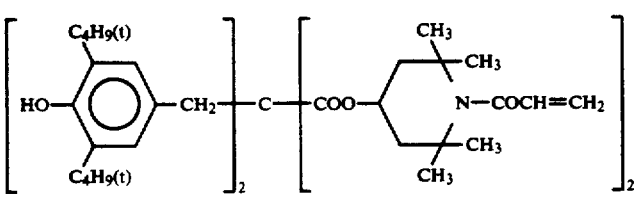

Coating amount was 0.19 g/m$^2$ that was optimum coating amount as an image-dye stabilizer.

As is apparent from the results in Table 2, with respect to Samples not containing any polymer, the ΔE value of Samples (B-3) to (B-8), which used yellow couplers of this invention is great in comparison with Samples (B-1) and (B-2); that is, the degree of the change in sensitivity is great, indicating that the storage stability after the production is poor. However, the ΔE value of Samples (C-3) to (C-12) of this invention, which used yellow couplers and polymers of this invention, is small; that is, the degree of the increase in sensitivity after the storage is small, and accordingly it can be understood that more excellent storage stability had been accomplished than in the cases of Samples (B-1), (B-2), (C-1) and (C-2), which used conventional yellow couplers.

On the other hand, where a conventionally known image stabilizer (Comparative Compound 1) was used, it can be understood that the degree of the change in sensitivity is further great and the storage stability is impaired considerably.

Having described our invention as related to the present embodiments, it is our intention that the invention not be limited by any of the details of the description, unless otherwise specified, but rather be construed broadly within its spirit and scope as set out in the accompanying claims.

What I claim is:

1. A silver halide color photographic material having at least one silver halide emulsion layer on a base, which comprises in said silver halide emulsion layer a dispersion including at least one yellow coupler represented by the following formula (1) or (2) and at least one water-insoluble homopolymer or copolymer:

Formula (1)

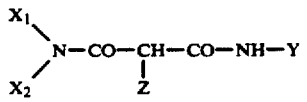

-continued

Formula (2)

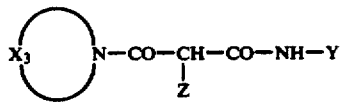

wherein $X_1$ and $X_2$ each represent an alkyl group, an aryl group, or a heterocyclic group, $X_3$ represents an organic residue required to form a nitrogen-containing heterocyclic group together with the >N-, Y represents an aryl group or a heterocyclic group, and Z represents a non-photographically useful group capable of being released upon a coupling reaction of the coupler represented by said formula with the oxidized product of a developing agent.

2. The silver halide color photographic material as claimed in claim 1, wherein the yellow coupler represented by formula (1) or (2) is selected from the group consisting of compounds represented by the following formula (I), (II), or (III):

Formula (I)

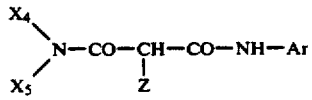

Formula (II)

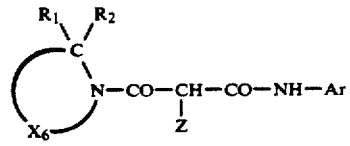

Formula (III)

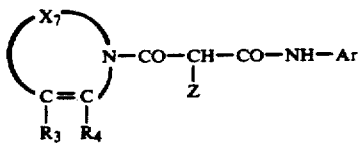

wherein Z represents a group capable of being released upon a coupling reaction of the coupler represented by formula (I), (II), or (III) with the oxidized product of a developing agent, $X_4$ represents an alkyl group, $X_5$ represents an alkyl group or an aromatic group, Ar represents a phenyl group having at least one substituent in the ortho position, $X_6$ represents an organic residue required to form a nitrogen-containing cyclic group together with the —C($R_1R_2$)—N<, $X_7$ represents an organic residue required to form a nitrogen-containing heterocyclic group together with the —C($R_3$)=C($R_4$)—N<, and $R_1$, $R_2$, $R_3$, and $R_4$ each represent a hydrogen atom or a substituent, $R_3$ and $R_4$ may bond together to form a ring.

3. The silver halide color photographic material as claimed in claim 1, wherein $X_1$ or $X_2$ in formula (1) is an alkyl group having 1 to 10 carbon atoms.

4. The silver halide color photographic material as claimed in claim 1, wherein Y in formulas (1) and (2) is a phenyl group having at least one substituent on the ortho position thereof.

5. The silver halide color photographic material as claimed in claim 1, wherein Z in formulas (1) and (2) is a 5- to 6-membered nitrogen-containing heterocyclic group bonded to the coupling site through the nitrogen atom, an aromatic oxy group, a 5- to 6-membered heterocyclic oxy group, or a 5- to 6-membered heterocyclic thio group.

6. The silver halide color photographic material as claimed in claim 1, wherein the coupler represented by formula (1) or (2) forms a dimer or higher polymer by bonding at the groups represented by $X_1$ to $X_3$, Y, and Z through a divalent group or more higher polyvalent group.

7. The silver halide color photographic material as claimed in claim 1, wherein the coupler represented by formula (1) or (2) is a nondiffusible coupler.

8. The silver halide color photographic material as claimed in claim 1, wherein the coupler represented by formula (1) or (2) is contained in the range of 0.1 to 1.0 mol per mol of the silver halide in the layer where the yellow coupler is used.

9. The silver halide color photographic material as claimed in claim 1, wherein the water-insoluble polymer homopolymer or copolymer is selected from the group consisting of vinyl polymers, polyester resins obtained by condensation of a polyhydric alcohol with a polybasic acid, polycarbonate resins obtained by condensation of a glycol or a dihydric phenol with a carbonate or phosgene, polyurethane resins obtained by polyaddition of a polyhydric alcohol with a polyvalent isocyanate, polyesters obtained by ring opening polymerization, and mixtures thereof.

10. The silver halide color photographic material as claimed in claim 1, wherein the molecular weight of water-insoluble homopolymer or copolymer is 300,000 or below.

11. The silver halide color photographic material as claimed in claim 1, wherein the weight ratio of water-insoluble homopolymer or copolymer to coupler is in a range from 1:20 to 20:1.

12. The silver halide color photographic material as claimed in claim 1, wherein the water-insoluble homopolymer or copolymer is selected from the group consisting of polymethyl methacrylate, poly-n-butyl acrylate, poly-n-butyl methacrylate, 1,4-butanediol adipic acid polyester, methyl methacrylate/styrene copolymer, n-butyl methacrylate/methyl methacrylate/styrene copolymer, cyclohexyl methacrylate/methyl methacrylate/n-propyl methacrylate copolymer, poly(N-tert-butyl acrylamide), methyl methacrylate/hexyl methacrylate copolymer, poly(cyclohexyl methacrylate), poly(p-tert-butylstyrene), poly(N-t-butyl methacrylamide), poly(vinyl acetate), N-t-butyl acrylamide/methylphenyl methacrylate copolymer, and N-t-butyl methacrylamide/vinylpyridine copolymer.

* * * * *